United States Patent [19]

Heiman

[11] Patent Number: 4,493,411

[45] Date of Patent: Jan. 15, 1985

[54] SELF TUNING LOW FREQUENCY PHASE SHIFT COIN EXAMINATION METHOD AND APPARATUS

[75] Inventor: Frederic P. Heiman, Philadelphia, Pa.

[73] Assignee: Mars, Inc., McLean, Va.

[21] Appl. No.: 428,467

[22] Filed: Sep. 29, 1982

[51] Int. Cl.[3] ..... G07F 3/02

[52] U.S. Cl. ..... 194/100 A; 73/163

[58] Field of Search ..... 194/100 R, 100 A; 324/233; 307/262; 133/3 R; 73/163

[56] References Cited

U.S. PATENT DOCUMENTS 3,966,034 6/1976 Heiman et al. ..... 194/100 A 4,398,626 8/1983 Barnes ..... 194/100 R X

*Primary Examiner*—Stanley H. Tollberg

*Attorney, Agent, or Firm*—Davis Hoxie Faithfull & Hapgood

[57] ABSTRACT

A method and apparatus for coin examination which transmits on one side of a coin a low frequency electromagnetic field from a transmitter inductor which is part of a transmitter circuit, monitors the frequency of the low frequency electromagnetic field, receives a portion of the field on the other side of the coin with a receiving inductor which is part of a receiving circuit, measures the phase shift between the transmitted signal and the received signal, and determines if the measured phase shift corresponds to the phase shift for an acceptable coin at the monitored frequency.

25 Claims, 10 Drawing Figures

SELF TUNING LOW FREQUENCY PHASE SHIFT COIN EXAMINATION METHOD AND APPARATUS

FIELD OF INVENTION

The present invention relates to examination of coins for authenticity and denomination, and more particularly to an adjustment-free mechanism especially useful for the examination of coin material characteristics through the use of a low frequency electromagnetic field.

BACKGROUND OF THE INVENTION

It has long been recognized in the coin examining art that the interaction of an object with a low frequency electromagnetic field can be used to indicate, at least in part, the material composition of the object and thus whether or not the object is an acceptable coin and if acceptable its denomination. See, for example, U.S. Pat. No. 3,059,749. It has also been recognized that such low frequency tests are advantageously combined with one or more tests at a higher frequency. See, for example, U.S. Pat. No. 3,870,137 assigned to the assignee of the present application. The optimum methods for low frequency testing have, in the past, used bridge circuits which incorporate testing of both phase and amplitude effects of coin interaction with an electromagnetic field.

Another technique which has been popular in the testing of coins has been the transmit-receive technique in which an electromagnetic field is created by an inductor adjacent one face of a coin and characteristics of the received signal adjacent the other face are examined as a step in determining the coin's authenticity and denomination. For example, each of U.S. Pat. Nos. 3,599,771 and 3,741,363 discloses a transmitter coil creating an electromagnetic field at either end. Spaced adjacent each end of the transmitter coil is a secondary coil. The two secondary coils are electrically connected in series, and have opposing orientations with respect to the transmitting coil field. An unknown coin is placed between one secondary coil and the transmitting coil and a known coin is placed between the other secondary coil and the transmitting coil. The unknown coin is accepted only if the signal delivered by the secondary coils does not exceed a threshhold value. Such an arrangement, of course, is suitable only for examination of one coin denomination per testing station.

U.S. Pat. No. 3,966,034, assigned to the assignee of the present application, discloses a phase sensitive coin discrimination method and apparatus operating by the transmit-receive technique with particular utility in distinguishing between two similar coins such as the British 5 P and the West German 1 DM. Unlike the present invention, the detailed embodiments of that patent operate at relatively high frequencies (for example 320 kHz) and rely upon differences in coin volume to help distinguish between otherwise similar coins.

U.S. Pat. No. 4,086,527, discloses a transmit-receive type coin examining apparatus in which the transmitter coil is driven by a controlled variable frequency oscillator operated at one or more selected frequencies in the range of 5–300 kHz. The secondary or receiving coil is connected to an undisclosed "quantifying operator" circuit which obtains quantitative information regarding amplitude of the secondary signal and its phase with respect to the primary (transmitted) signal.

U.S. Pat. No. 4,398,626, assigned to the assignee of the present application discloses a transmit-receive type coin examination method and apparatus in which a nonlinear amplifier is employed between the receiving inductor and the phase shift measuring means in order to introduce an additional phase shift which is inversely related to the amplitude of the output of the receiving inductor. The additional phase shift improves the capability of the apparatus of the application to discriminate between various coins and particularly to discriminate between coins which produce nearly the same phase shift as measured by phase shift measuring circuitry lacking the nonlinear amplifier disclosed in U.S. Pat. No. 4,398,626.

European Patent Application No. 0 048 557, filed Sept. 2, 1981, discusses an electronic coin validator having a transmit coil and a receive coil for performing tests of coin face area and coin resistance. An automatic gain control circuit is described for use in modifying signal amplitude to provide compensation. This gain control circuit apparently has as its basic input the received signal amplitude for a transmitted signal having a frequency below 1 kHz. At least one absolute adjustment is needed to set up the validator in production.

Generally, low frequency test apparatus require at least one tuning element and at least one tuning adjustment during the manufacturing of such apparatus to compensate for components having slightly different values within tolerance and for variations in component positioning which occur during the construction of the test apparatus. For example, in low frequency coin test apparatus employing a bridge circuit, the bridge circuit is normally tuned to both the amplitude and the phase of the signal received when an acceptable coin is in the test position. An additional problem long recognized in the coin testing art is the problem of how to compensate for component aging, for changes in the environment of the coin apparatus such as temperature changes, and for similar disruptive variations which result in undesirable changes in the operating characteristics of the electronic circuits employed in coin test apparatus. Various discrete compensation circuits have been developed to meet this problem. See, for example, U.S. Application No. 308,548, filed Oct. 2, 1981 and assigned to the assignee of the present invention.

SUMMARY OF THE INVENTION

The present invention relates to a method and apparatus for examining the interaction of coins with a relatively low frequency electromagnetic field at which the coin material plays a significant role. The transmit-receive technique is used and the phase shift that results from the presence of a coin or other object between the transmitting inductor, which creates the field, and the receiving inductor is used as an indication of the identity of the coin. The present invention provides a novel method and apparatus which eliminates the need for any tuning adjustments related to the low frequency test and also eliminates the need for discrete compensation circuitry. The benefits of the present invention are achieved by monitoring the frequency of the transmitted signal and adjusting the coin identification criterion based upon the monitored frequency of the transmitted signal.

Other features and advantages of the invention will be clear from the drawings and the detailed description of an embodiment of the invention which follows.

Figure 1:
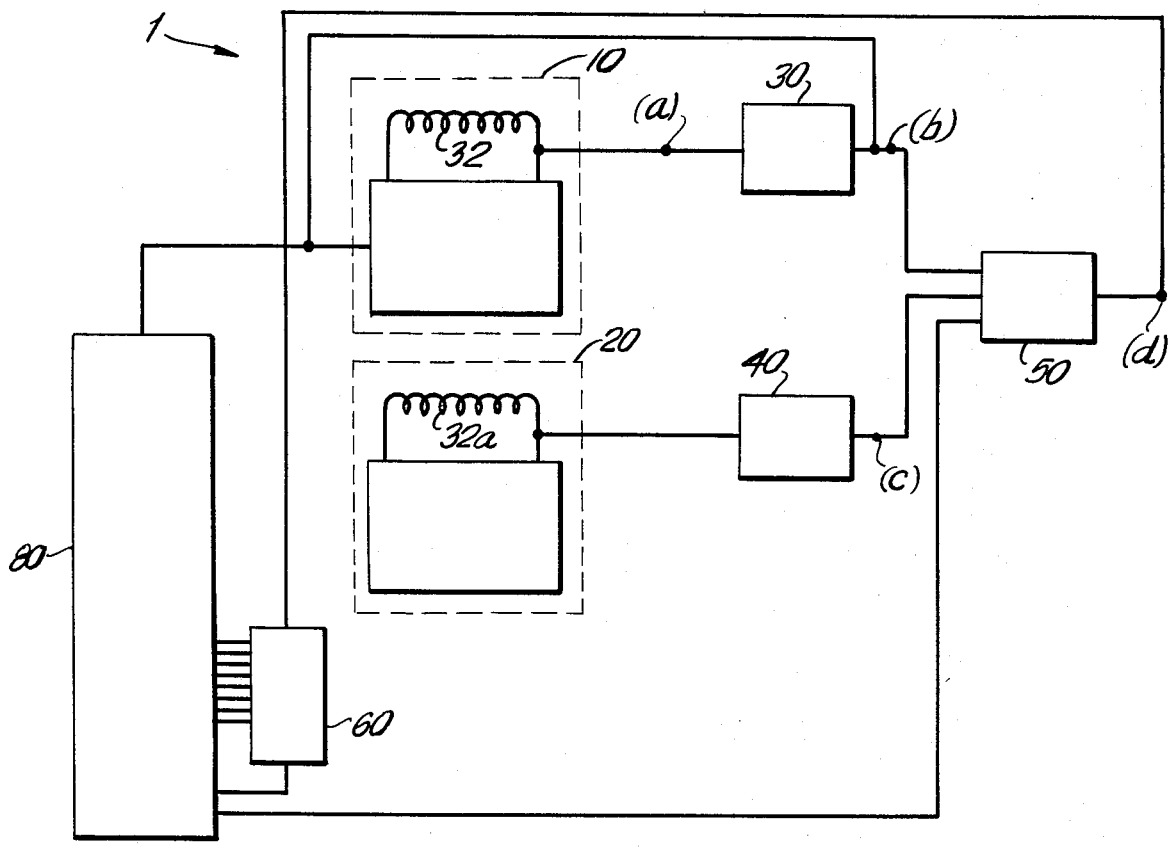
FIG. 1 is a schematic block diagram of an embodiment of the coin examining circuit in accordance with the invention.

FIGS. *2a–d* graphically illustrate the signals produced at the points (*a*)–(*d*) in the coin examining circuit of FIG. 1.

Figure 3:
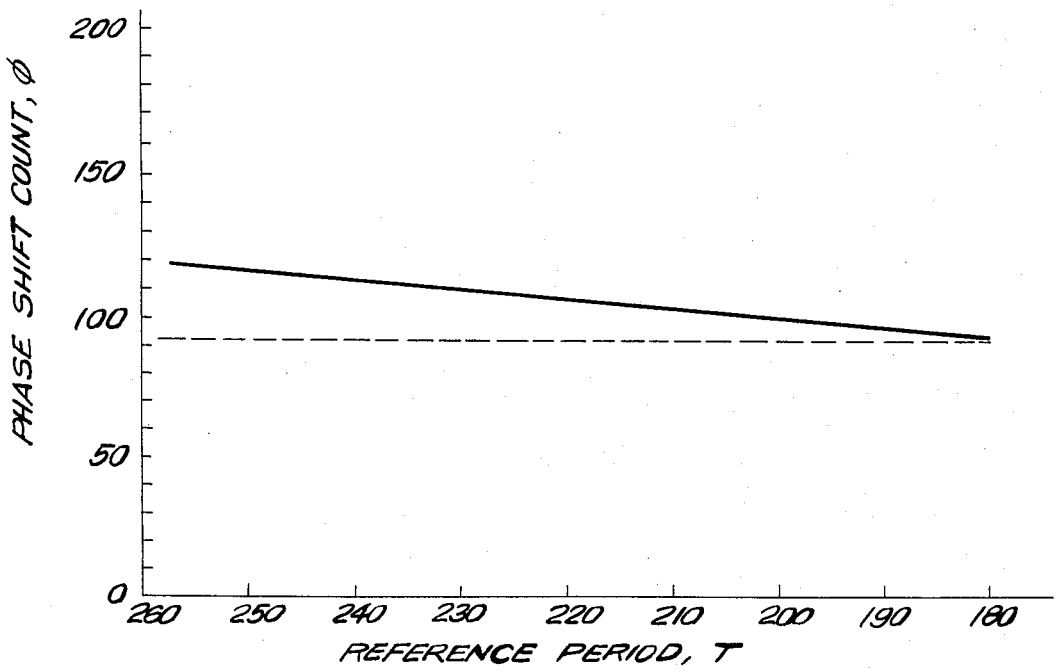
Figure 2A:
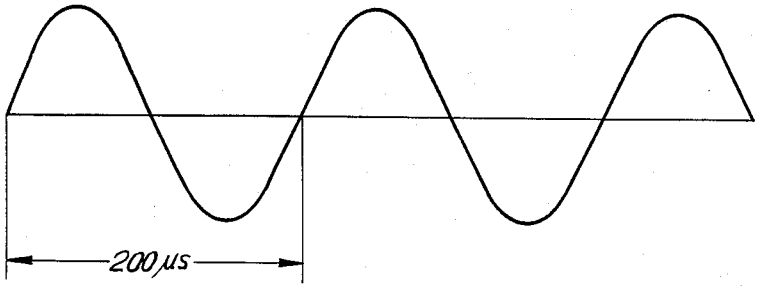
Figure 2B:
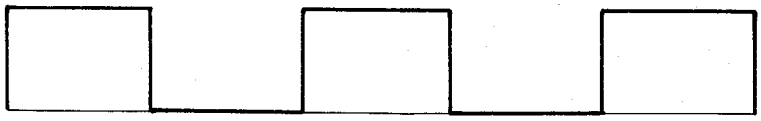
Figure 2C:
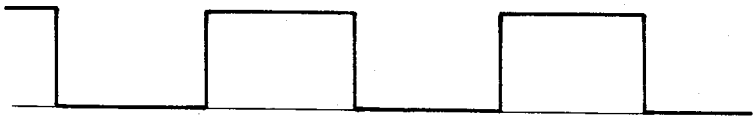
Figure 2D:
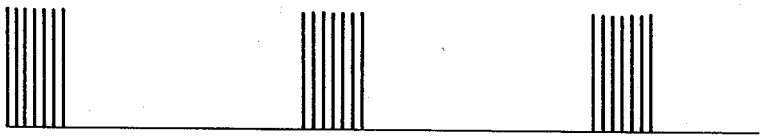
Figure 4:
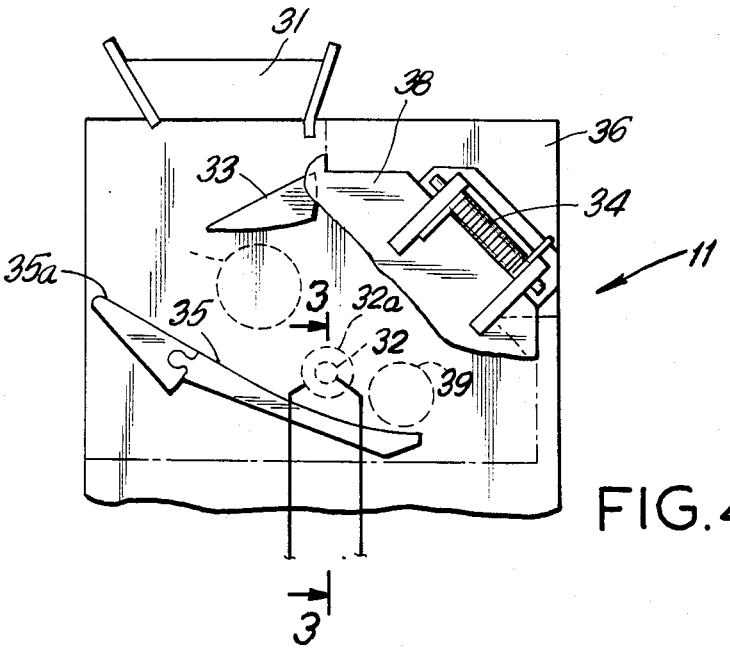
Figure 5:
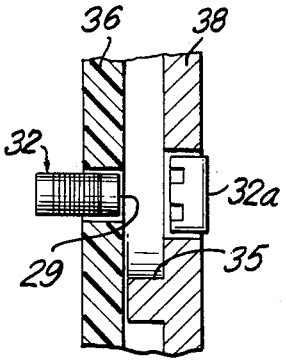
Figure 6:
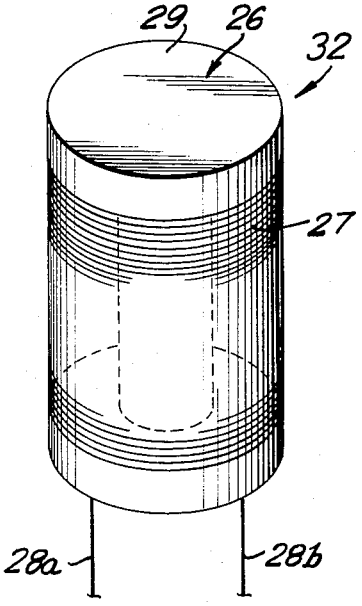
Figure 7:
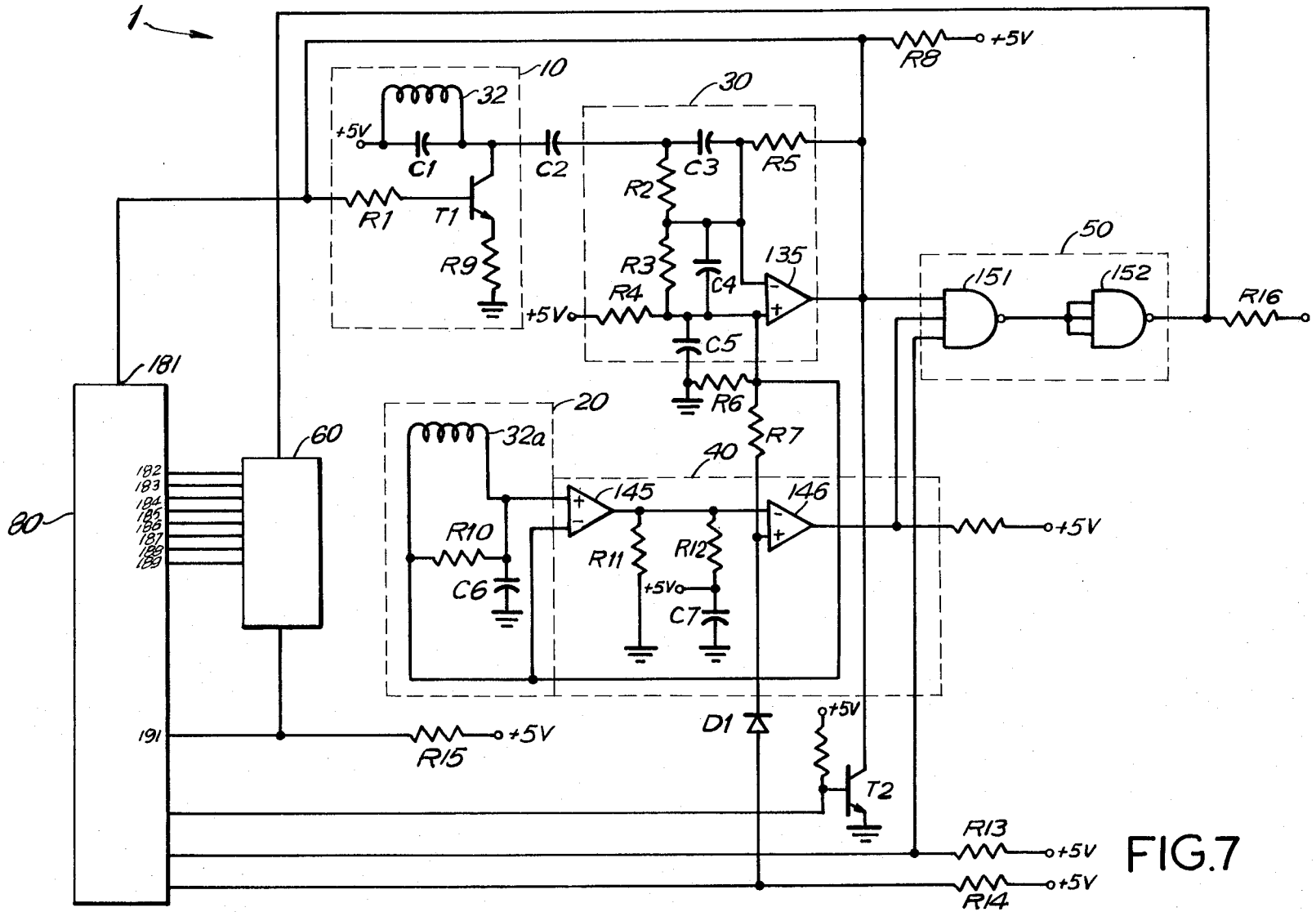

FIG. 3 is a graph of phase shift count versus reference period for 25-cent coins;

FIG. 4 is a schematic diagram illustrating the incorporation into a coin handling mechanism of transmit and receive inductors suitable for the embodiment of FIG. 1;

FIG. 5 is a cross-sectional view of a coin passageway along line 3—3 of FIG. 4 showing one arrangement of transmitting and receiving inductors suitable for the embodiment of FIG. 1;

FIG. 6 illustrates a transmitting inductor suitable for the embodiment of FIG. 1;

FIG. 7 is a detailed schematic diagram of a circuit suitable for the embodiment of FIG. 1.

Although coin selector apparatus constructed in accordance with the principles of this invention may be designed to identify and accept any number of coins from the coin sets of many countries, the invention will be adequately illustrated by explanation of its application to identifying the U.S. 5-, 10-, and 25-cent coins. The figures are intended to be representational and are not necessarily drawn to scale. Throughout this specification the term "coin" is intended to include genuine coins, tokens, counterfeit coins, slugs, washers, and any other item which may be used by persons in an attempt to use coin-operated devices. Furthermore, from time to time in this specification, for simplicity, coin movement may be described as rotational motion; however, except where otherwise indicated, translational and other types of motion also are contemplated. Similarly, although specific types of logic circuits are disclosed in connection with the embodiments described below in detail, other logic circuits can be employed to obtain equivalent results without departing from the invention.

DETAILED DESCRIPTION

FIG. 1 shows a block schematic diagram of a coin examining circuit 1 in accordance with the present invention. The coin examining circuit 1 includes a transmitter 10 having a transmitting inductor 32, a receiver 20 having a receiving inductor 32*a*, a first squaring circuit 30 with one input connected to the transmitter 10 and its output connected as a feedback input to the transmitter 10, a second squaring circuit 40 with an input connected to the receiver 20, gating circuit 50 connected to outputs of the squaring circuits 30 and 40, a counter 60 connected to the output of gating circuit 50, and a logic control means 80. The logic control means 80 is connected to the transmitter 10, the output of the first squaring circuit 30, one input of gating circuit 50, a reset input of the counter 60 and the output of the counter 60 which is shown in FIG. 1 as an eight bit parallel connection.

The operation of coin examining circuit 1 is as follows. The transmitter 10 produces a sine wave oscillator signal which drives transmitting inductor 32. In this embodiment, this sine signal is a low frequency signal with a resonant frequency of 5 kHz. Inductor 32 produces an electromagnetic field in a test region of a coin passageway (see FIG. 4 and the discussion thereof below for details of the relationship of the transmitting inductor 32, coin passageway and receiving inductor 32*a*). The oscillator signal is transmitted by transmitting inductor 32 across the low frequency test region. As a coin passes through the test region between inductors 32 and 32*a*, it is subjected to the electromagnetic field and a phase shift dependent upon the coin's material is introduced. The receiving inductor 32*a* receives a phase shifted signal which has been transmitted across the coin passageway.

The phase difference between the signal transmitted by transmitter 10 (transmitted signal) and the signal received by receiver 20 (received signal) is indicative of coin material and is measured as discussed below. The sine wave signal produced by transmitter 10 is fed as an input to the first squaring circuit 30. Squaring circuit 30 transforms by conventional means the sine wave connected to its input into a square wave which appears at its output. The signal received by receiver 20 is connected to the input of the second squaring circuit 40 which inverts the sine wave at its input and similarly transforms the inverted sine wave into a square wave appearing at its output. The square wave outputs of both the squaring circuits 30 and 40 along with a rapid clock signal from logic control means 80 serve as the inputs of gating circuit 50. Gating circuit 50 ANDs together the signals applied to its inputs. The output of the gating circuit 50 consists of a series of bursts of pulses with the number of pulses in each burst being indicative of the phase shift between the transmitted and the received signals.

The relationship of the various waveforms and signals discussed above is illustrated in FIG. 2. Waveforms 2(*a*)–2(*d*) are representative of typical waveforms which might be observed at the points (*a*)–(*d*) shown in FIG. 1. FIG. 2(*a*) shows a sine wave output signal for transmitter 10 having a period (T) of 200 usec and a frequency (f) of 5 kHz. FIG. 2(*b*) shows the square wave output of first squaring circuit 30 when the waveform of FIG. 2(*a*) is applied as its input. It should be noted that this square wave output has the same frequency as the input sine wave. FIG. 2(*c*) shows the output of second squaring circuit 40. The output of second squaring circuit 40 consists of its input signal squared and inverted. Finallly, FIG. 2(*d*) shows the output of the gating circuit 50 which consists of a series of bursts of pulses.

The output of gating circuit 50 is connected to an input of the counter 60 which counts the number of pulses in each burst and produces an output count signal indicative thereof. The output count signal of counter 60 is supplied as one input to the logic control means 80. Between bursts, a reset signal is supplied by the logic control means 80 to an input of counter 60 so that the counter 60 is reset before each burst.

A second input of logic control means 80 is connected to the output of the first squaring circuit 30. The logic control means 80 continually monitors the frequency of the transmitted signal by monitoring the frequency of the output of the first squaring circuit 30. Based upon the frequency of the transmitted signal just prior to or just after the time when an output count signal is fed to logic control means 80 by counter 60, the logic control means 80 determines an acceptable phase shift for an acceptable coin. For example, the logic control means 80 may produce a signal indicative of a number or a range of numbers corresponding to those for an acceptable coin at the monitored frequency. This signal is then compared with the output from counter 60 and the logic control means 80 produces an output signal indicative of whether the coin passing through the test region of the coin passageway is an acceptable coin or not.

FIG. 3 shows a plot of phase shift count $\phi$ for acceptable 25-cent coins versus the reference period T in microseconds of the transmitted signal, where the reference period T is the reciprocal of the reference or monitored frequency f of the transmitted signal. This plot was experimentally determined using apparatus according to the present invention. From the plot of FIG. 3, it can be seen that for 25-cent coins the phase shift count $\phi=86+0.30\ (T-175)$ or $\phi\approx 86+(\frac{1}{4}+1/32+1/64)\ (T-175)$. Such information can be stored in logic control means 80 using any suitable means, such as storing a look-up table, or can be generated by a program such as microprocessor program or a similar computing means. Like information for 10-cent and 5-cent coins can similarly be determined and stored in the logic control means 80 when the coin examining circuit 1 is to be used for examining United States coins. It is readily apparent that the system described above can be easily adapted to any other coin set by storing the appropriate phase count information for that coin set in the logic control means 80.

The above-described coin examining circuit 1 avoids the need for factory tuning to adjust for different component values within component tolerance or for positioning errors within manufacturing tolerance in positioning the transmitting inductor 32 and the receiving inductor 32*a*. Further, the above described coin examining circuit 1 avoids the need for returning due to component aging, power supply drift or the like and also avoids the need for discrete compensation circuitry to compensate for component aging, drift or the like and environmental changes such as temperature changes. The adjustment free operation of coin examining circuit 1 results from the fact that for apparatus according to the invention, the phase shift count depends only on the frequency of the transmitted signal which is continually monitored and taken into consideration by logic control means 80 in making the coin acceptance decision. Other variables such as the value of the transmitter and receiver inductances, the separation of the transmitter and receiver inductors 32 and 32*a*, the coin position with respect to the coils 32 and 32*a* when the coin is in the test position and variations in the component values of other components in the coin examining circuit 1, either have an insignificant effect on the phase shift count or result in a change in the frequency of the transmitted signal and consequently are compensated for by logic control means 80.

The incorporation of this embodiment into a coin handling mechanism is illustrated in FIGS. 4 and 5. FIGS. 4 and 5 show the mechanical portion of a coin handling apparatus 11 including transmitter and receiver inductors 32 and 32*a* appropriately located along a coin passageway. (A relatively higher frequency inductive coin examining circuit, such as that disclosed in a U.S. patent application entitled "Coin Examination Apparatus Employing an RL Relaxation Oscillator", Ser. No. 294,997, filed Aug. 21, 1981 and assigned to the assignee of this application, can be advantageously incorporated in the same apparatus for more complete testing of coin characteristics. The locations of inductors as disclosed in an embodiment of that application are indicated by the broken lines 37 and 39 in FIG. 4 of the present application.)

The coin handling apparatus 11 also includes a conventional coin receiving cup 31, two spaced sidewalls 36 and 38, connected by a hinge and spring assembly 34 in a manner similar to that shown in U.S. Pat. No. 3,970,086, except that the retarding apparatus for sidewall closing disclosed in that patent is not necessarily used. The sidewalls 36, 38 are tipped slightly from the vertical so that the coins bear facially on the sidewall in which the receiver inductor 32*a* is located, here the front sidewall 38. The portions of the apparatus 11 shown in FIGS. 4 and 5 also include a first coin track 33 under the coin entry cup 31 comprising an edge of a first energy dissipating device, and a second coin track 35 comprising an edge of a second energy dissipating device 35*a*, which forms the initial track section, and a terminal track section which is molded from plastic along with the sidewall 36. The energy dissipating devices 33, 35*a*, track 35 and sidewalls 36 and 38 form a coin passageway from the coin entry cup 31 past the coin testing inductors 32 and 32*a*. Coins entering the apparatus 11 fall edgewise onto a first energy dissipating element 33, roll off and fall onto a second energy dissipating element 35*a* which forms the initial section of a coin track 35 on which the coins roll past the transmitter inductor 32 and the receiver inductor 32*a*.

The transmitter inductor 32, shown in FIG. 6, is of a type designed to produce a projecting magnetic field from its ends. The core 26 of the transmitter inductor 32 is dumbbell shaped, in this case, having two relatively large diameter cylindrical end pieces connected by a smaller diameter central section. The coil 27 is wound about the central section of the core 26 and the ends of the coil 27 are connected to leads 28*a* and *b*.

As shown in FIGS. 4 and 5, the transmitter inductor 32 is located in a recess in the plastic back sidewall 36 of the coin apparatus with one end 29 adjacent the coin passageway formed by sidewalls 36 and 38. In a recess in the opposite, front sidewall 38 is the receiver inductor 32*a*. It is of the conventional pot core type. The axes of the two inductors 32 and 32*a* coincide in this embodiment, although they need not do so in all embodiments of the invention.

In this embodiment, which is designed primarily for identification of United States coinage, the nearest faces of the inductors 32 and 32*a* are about 3.8 mm apart. The axes of the inductors 32 and 32*a* are located 9.77 mm above the track 35 on which coins roll as they pass through the coin testing section of the apparatus. It is an important benefit of the present invention that positioning errors within normal manufacturing tolerances have no significant effect on the effectiveness of the low frequency test and such positioning errors do not result in a requirement for a tuning adjustment. The transmitter inductor 32 is 10 mm long by 8 mm in diameter with a central section 3.6 mm long, and has an inductance of 10 mH. The receiver inductor 32*a* is approximately 7 mm deep by 13.63 mm in diameter and has an inductance of 23 mH.

FIG. 7 is a detailed schematic diagram of the circuit 1 shown in FIG. 1 in block form. As discussed above, the transmitter 10 includes a transmitter inductor 32 and produces a low frequency sine wave signal, the transmitted signal, which is coupled to the input of the squaring circuit 30. FIG. 7 shows this coupling as being through a capacitor C2. The squaring circuit 30 is based upon a comparator 135 which may suitably be one section of a National Semiconductor type LM339 open collector comparator. The output of comparator 135 is a first square wave having the same frequency as the sine wave signal produced by transmitter 10. This first square wave output provides pulses of drive current through resistor R1 to the base of transistor T1. The square wave output of comparator 135 also serves as one input of gating circuit 50.

A second input of gating circuit 50 is connected to the output of the second squaring circuit 40. A first comparator 145 in squaring circuit 40 inverts the received signal from receiver 20. A second comparator 146 transforms the inverted output from comparator 145 into a second square wave output. Both of the comparators 145 and 146 may consist of one section of a National Semiconductor type LM339 open collector comparator.

A third input of gating circuit 50 is connected to a clock output of a logic means 80 such as an Intel type 8048 microprocessor. The gating circuit 50 consists of two 3-input NAND gates 151 and 152, such as National Semiconductor type 74LS10, connected together as an AND gate. The three inputs to gating circuit 50 are connected as the three inputs of NAND gate 151 and the output of NAND gate 151 is connected to all three inputs of NAND gate 152 so that NAND gate 152 serves as an inverter.

The output of gating circuit 50 is a series of pulse bursts with the number of pulses in each burst being indicative of the phase shift between the transmitted signal and the received signal. The number of pulses in each burst relates to the phase shift as follows. Each burst occurs during the time that the outputs of the squaring circuits 30 and 40 are both high. The number of pulses in each burst is the number of clock pulses from the clock output of microprocessor 80 occurring during that time. Since the time of coincidence of high outputs from the squaring circuits 30 and 40 is directly related to the phase shift between the transmitted and the received signals, the number of pulses in each burst is an indication of the phase shift.

The number of pulses at the output of gating circuit 50 and the phase shift produced by any coin under test will vary depending on the frequency of the transmitted signal. Circuit 1 compensates for any frequency change as follows. Microprocessor 80 monitors the frequency of the signal applied to its input 181. The output of first squaring circuit 30 is connected to the input 181. Since the output of squaring circuit 30 is a square wave having the same frequency as the transmitted signal, the microprocessor 80 monitors the frequency of the transmitted signal by monitoring the output of squaring circuit 30. Depending upon the frequency of the signal applied to input 181, microprocessor 80 determines a count or a range of counts corresponding to those for an acceptable coin and the monitored frequency. For example, microprocessor 80 may store phase shift counts or an equation for computing phase shift counts from the monitored frequency for 5-, 10-, and 25-cent coins as discussed above with regard to FIG. 3 and determine therefrom an appropriate count for the monitored frequency.

The output of gating circuit 50 is connected to a counter 60, such as a National Semiconductor type 4520 counter, which produces an output count signal corresponding to the number of pulses in each burst of the output of gating circuit 50. This count signal is fed as an eight-bit parallel input to inputs 182–189 of microprocessor 80. The microprocessor 80 compares the count fed to inputs 182–189 with the count determined for an acceptable coin and the monitored frequency, and determines if the coin under test has the material of an acceptable coin. An output 191 of microprocessor 80 is connected to a reset input of counter 60. After each count is fed from counter 60 to microprocessor 80, microprocessor 80 produces a reset signal at its output 191 so that counter 60 is reset between the bursts appearing at the output of gating circuit 50.

In a preferred embodiment of the circuit 1, the following components and component values are used:

| | |
|---|---|
| Inductors | |
| 32 | 10mH |
| 32a | 23mH |
| Resistors | |
| R1 | 100k |
| R2 | 100K |
| R3 | 100k |
| R4 | 1k |
| R5 | 10M |
| R6 | 1k |
| R7 | 470k |
| R8 | 2.2k |
| R9 | 1.2k |
| R10 | 27k |
| R11 | 4.7k |
| R12 | 2.2k |
| R13 | 4.7k |
| R14 | 4.7k |
| R15 | 4.7k |
| R16 | 1k |
| Capacitors | |
| C1 | .1uF |
| C2 | .1uF |
| C3 | 82pF |
| C4 | 8pF |
| C5 | 1uF |
| C6 | .001uF |
| C7 | .01uF |
| Transistors | |
| T1 | 2N3563 |
| T2 | 2N3563 |
| Diode | |
| D1 | 1N4148 |

Also, in the preferred embodiment, the following microprocessor program is used to control the functioning of microprocessor 80:

```
LOC  OBJ          SEQ          SOURCE STATEMENT

                   1
                   2 ;                                  ****
                   3 ;          ****************      *******
                   4 ;           **************     *******
                   5 ;            *************    ****
                   6 ;       ****************** **** ***************
                   7 ;       ****************** **  ** ***************
                   8 ;       ******************  ** ****************
                   9 ;       ***********************************
                  10 ;       ***********************************
                  11 ;       *****                 ****************
                  12 ;       *****                  ***************
                  13 ;       *****                   **************
                  14 ;       *****                    *************
                  15 ;       *****                     ************
                  16 ;       *****   * ****             ***********
                  17 ;       *****   * ****              **********
                  18 ;       *****   ** *** MARS          *********
                  19 ;       *****   *** **                ********
                  20 ;       *****   **** *          tm     *******
                  21 ;       *****   **** *                  ******
                  22 ;       *****          ELECTRONIC        *****
                  23 ;       *****                             ****
                  24 ;       *****                             ****
                  25 ;       *****                             ****
                  26 ;       *****                             ****
                  27 ;       ***************************************
                  28 ;       ***************************************
                  29 ;       ***************************************
                  30 ;       ***************************************
                  31 ;       ***************************************
                  32 ;       ***************************************
                  33 ;       ***************************************
                  34 ;       ***************************************
                  35 ;       ***************************************
                  36 ;       ***************************************
                  37 ;       *****         *       *     ***********
                  38 ;       **** ********* ******* ***** **********
                  39 ;       **** ********* ******* ***** ****  ****
                  40 ;       **** ********* ******* ***** **********
                  41 ;       **** **** **** *** *** ** ** **********
                  42 ;       **** **** **** *** *** ** ** ****  ****
                  43 ;       **** ********* ******* ***** **********
                  44 ;       **** ********* ******* ***** **********
                  45 ;       **** ********* ******* ***** ****  ****
                  46 ;       **** **** **** *** *** ** ** **********
                  47 ;       **** **** **** *** *** ** ** **********
                  48 ;       **** ********* ******* ***** **********
                  49 ;       **** ********* ******* ***** **********
                  50 ;       **** ********* ******* ***** **********
                  51 ;       **** **** **** *** *** ** ** **********
                  52 ;       **** **** **** *** *** ** ** **********
                  53 ;       **** ********* ******* ***** **********
                  54 ;       **** ********* ******* ***** **********
                  55 ;       **** ********* ******* ***** **********
                  56 ;       **** **** **** *** *** ** ** **********
                  57 ;       **** **** **** *** *** ** ** **********
                  58 ;       **** ********* ******* ***** **********
                  59 ;       **** ********* ******* ***** **********
                  60 ;       **** ********* ******* ***** **********
                  61 ;       ***************************************
                  62 ;       ***************************************
                  63 ;
                  64
                  65 $EJECT
                  66
                  67 ;Port assignments
                  68
0001              69 ADR0     EQU     01H     ;Port 1-0   74156 address bit 0
0002              70 ADR1     EQU     02H     ;Port 1-1     '       '     '  1
0004              71 ADR2     EQU     04H     ;Port 1-2     '       '     '  2
0008              72 HF1      EQU     08H     ;Port 1-3   HF1 osc. enable
                  73
0010              74 HF2      EQU     10H     ;Port 1-4   HF2 osc. enable
0020              75 STRBE    EQU     20H     ;Port 1-5   Strobe osc. enable
0040              76 LFREF    EQU     40H     ;Port 1-6   LF reference enable
0080              77 RST      EQU     80H     ;Port 1-7   Hardware counter reset
                  78
0001              79 DLRSW    EQU     01H     ;Port 2-0   Dollar coin switch
0002              80 HILOSW   EQU     02H     ;Port 2-1   Quarter Hi/Low switch
0004              81 USCSW    EQU     04H     ;Port 2-2   U.S./Can. coin switch
0008              82 GATE1    EQU     08H     ;Port 2-3   Gate 1 control
                  83
0010              84 GATE2    EQU     10H     ;Port 2-4   Gate 2 control
0020              85 SEND     EQU     20H     ;Port 2-5   Send enable NOT
0040              86 INTR     EQU     40H     ;Port 2-6   Interupt request NOT
0080              87 DATA     EQU     80H     ;Port 2-7   Data NOT
                  88
                  89 ;T1                      ;Accept Enable NOT
                  90 ;T0                      ;2 Mhz output
                  91
                  92
```

```
LOC  OBJ          SEQ        SOURCE STATEMENT

                   93 ;CONSTANTS
                   94
00F4               95 ITIME    EQU     0F4H            ;INTERRUPT TIME
0001               96 CALTIM   EQU     001H            ;Time between calibrates
00FF               97 ERDT     EQU     0FFH            ;Esc. ret. default time
00FF               98 CDDT     EQU     0FFH            ;Coin drop default time
                   99
                  100
0001              101 ARR1     EQU     1               ;HF1 ARRIVAL FLAG
0002              102 ARR2     EQU     2               ;HF2 ARRIVAL FLAG
0004              103 DEPRT1   EQU     4               ;HF1 DEPARTURE FLAG
0008              104 DEPRT2   EQU     8               ;HF2 DEPARTURE FLAG
0010              105 INHIB    EQU     10H             ;COIN INHIBIT FLAG
0020              106 ERTN     EQU     20H             ;ESCRO RETURN FLAG
0040              107 DBLARR   EQU     40H             ;DOUBLE ARRIVAL FLAG
0080              108 CALFLG   EQU     80H             ;CALIBRATION FLAG
                  109
0008              110 ARRIV1   EQU     8               ;HF1 ARRIVAL FULL COUNT
0006              111 ARRIV2   EQU     6               ;HF2 ARRIVAL FULL COUNT
0003              112 DPART1   EQU     3               ;HF1 DEPARTURE FULL COUNT
0003              113 DPART2   EQU     3               ;HF2 DEPARTURE FULL COUNT
0014              114 ERTN1    EQU     20              ;ESCRO RETURN FULL COUNT
0002              115 EROFF    EQU     02              ;Escro return off full
                  116
                  117 ; Non coin type messages
                  118
0073              119 PWRUP    EQU     73H             ;POWER-UP MESSAGE
0077              120 DFCTIV   EQU     77H             ;DEFECTIVE SENSOR MESSAGE
007B              121 SLUG     EQU     7BH             ;INVALID COIN MESSAGE
007E              122 ESCRET   EQU     7EH             ;ESCROW RETURN MESSAGE
007F              123 NOSTRB   EQU     7FH             ;NO STROBE MESSAGE
                  124
0013              125 DCDFLT   EQU     13H             ;DOLLAR DEFAULT MESSAGE
0017 ←            126 ERDFLT   EQU     17H ←           ;Escro ret default timeout
001B              127 CDDFLT   EQU     1BH ←           ;Coin drop
                  128
0033              129 DBLCN    EQU     33H             ;Double arrival message
0037              130 STBJAM   EQU     37H             ;Jammed strobe message
                  131
                  132
                  133
                  134 $EJECT
                  135
                  136          ;RAM ASSIGNMENTS
0020              137          ORG     20H
0001              138 CALIBT:  DS      1          ;Calibration timer
                  139
0002              140 FUSE1:   DS      2               ;REFR3
0002              141 FUSE2:   DS      2               ;REFR4
0002              142 FSAVE1:  DS      2               ;SAVECOUNT1
0002              143 FSAVE2:  DS      2               ;SAVECOUNT2
0001              144 DATA1:   DS      1               ;PEAKCOUNT1
0001              145 DATA2:   DS      1               ;PEAKCOUNT2
0001              146 DATA3:   DS      1               ;PEAKCOUNT3
0001              147 COIN1:   DS      1               ;COINWORD1
0001              148 COIN2:   DS      1               ;COINWORD2
0001              149 COIN3:   DS      1               ;COINWORD3
0001              150 STROB:   DS      1               ;Last strobe count
0001              151 REFLF:   DS      1               ;Last LF reference
0006              152 TUBES:   DS      6          ;Cointube sensor counts
0001              153 CNMESS:  DS      1          ;Coin message storage
                  154
                  155
0038              156 LFLIM    EQU     40H-8      ;LF limits ram
                  157
0017              158 ERDTIM   EQU     17H        ;Esc. ret. default timer
0016              159 CDDTIM   EQU     16H        ;Coin drop default timer
                  160
                  161
                  162
                  163
                  164          ;REGISTER ASSIGNMENTS
                  165
                  166 ;R7      SENSOR STATUS             (1=covered)
                  167 ;R6      BAD SENSOR STATUS         (1=good)
                  168 ;R5      MODE STATUS
                  169 ;R4-R0   GENERAL PURPOSE
                  170
                  171 ;Sensor status (R7 & R6) bit locations are
                  172 ;bit 0, 25c low      bit 4, 25c high
                  173 ;bit 1, 10c low      bit 5, 10c high
                  174 ;bit 2, 5c  low      bit 6, 5c  high
                  175
                  176 ;R0' thru R7' are used by LFCOMP and communications as
                  177 ;general purpose registers
                  178 .
                  179
                  180 $EJECT
```

```
LOC  OBJ        SEQ        SOURCE STATEMENT

                 181
0000             182              ORG      0
0000 00          183 BEGIN:       NOP
0001 99C0        184 START0:      ANL      P1,#3FH NOT      ;Disable all osc.
0003 75          185              ENT0     CLK              ;START 2MHZ CLOCK
0004 27          186              CLR      A
0005 0414        187              JMP      CLRRAM
                 188
                 189
0007             190              ORG      07H
                 191
0007 99C7        192 TINTR:       ANL      P1,#(HF1 OR HF2 OR STRBE) NOT
                 193
0009 C5          194              SEL      RB0
000A 2A          195              XCH      A,R2     ;Used by G2 timing
000B C612        196              JZ       EXG2
000D 07          197              DEC      A
000E 9612        198              JNZ      EXG2
0010 8A10        199              ORL      P2,#GATE2        ;De-energize gate 2
0012 2A          200 EXG2:        XCH      A,R2
0013 93          201              RETR
                 202
                 203
                 204
0014 B83F        205 CLRRAM:      MOV      R0,#3FH
0016 A0          206              MOV      @R0,A
0017 E816        207              DJNZ     R0,CLRRAM +2
                 208
0019 37          209              CPL      A
001A B828        210              MOV      R0,#FSAVE2+1     ;INITIALIZE SAVECOUNT
001C A0          211              MOV      @R0,A
001D C8          212              DEC      R0
001E C8          213              DEC      R0
001F A0          214              MOV      @R0,A
                 215
                 216 ;SIGN-ON WITH POWER-UP MESSAGE
                 217
0020 744A        218              CALL     RDSENS           ;READ COINTURE SENSORS
                 219
0022 2373        220              MOV      A,#PWRUP
0024 5482        221              CALL     DSEND            ;Set HiLow bit & send
                 222
0026 FE          223              MOV      A,R6             ;CHECK DEFECTIVE SENSOR
0027 37          224              CPL      A
0028 C62E        225              JZ       RESTRT -2        ;EXIT IF OK
002A 2377        226              MOV      A,#DFCTIV
002C 5482        227              CALL     DSEND            ;Send defective sensor
                 228
                 229 $EJECT
                 230
                 231 ;RESTART ROUTINE
                 232
002E BD90        233              MOV      R5,#90H          ;SET CALFLG & INHIB.
                 234
0030 FD          235 RESTRT:      MOV      A,R5
0031 53B0        236              ANL      A,#ERTN OR INHIB OR CALFLG
0033 AD          237              MOV      R5,A
0034 85          238              CLR      F0
0035 A5          239              CLR      F1
                 240
0036 B829        241              MOV      R0,#DATA1
0038 B906        242              MOV      R1,#06H
003A B000        243 CLRLP:       MOV      @R0,#00H
003C 18          244              INC      R0
003D E93A        245              DJNZ     R1,CLRLP
                 246
003F 7497        247              CALL     P1SET
                 248
0041 00          249 SCAN:        NOP
0042 8908        250              ORL      P1,#HF1          ;Start HF1
0044 7400        251              CALL     CNTHF            ;Count HF into R3 & R4
                 252
                 253                                        ;PROCESS HF1 DATA
0046 B821        254 HF1X:        MOV      R0,#FUSE1        ;Ref. count HF1
                 255
0048 FD          256              MOV      A,R5             ;CHECK RECALIBRATION
0049 F27C        257              JB7      CALHF1           ;RECALIBRATE?
                 258
004B 743E        259 HF1X0:       CALL     SUBTR            ;REFCOUNT1 - NEWCOUNT
004D C651        260              JZ       HF1XA    ;= trap not necessary !!!!
004F E653        261              JNC      HF1X1    ;NEWCNT >= REFCNT1? Y, CHK ARR
0051 BBFF        262 HF1XA:       MOV      R3,#0FFH         ;RESULT<0
                 263
0053 FB          264 HF1X1:       MOV      A,R3             ;CHECK FOR COIN ARRIVAL
0054 0308        265              ADD      A,#ARRIV1
0056 E669        266              JNC      HF1X3            ;FULLCNT1>=ARR1? Y,COMP
                 267                                        ;WITH PEAKCOUNT1
0058 FD          268              MOV      A,R5
0059 125D        269              JB0      HF1X2            ;ARR1=1? Y, CHECK DEPART
005B 0480        270              JMP      SCAN1
                 271
                 272
```

```
LOC  OBJ          SEQ          SOURCE STATEMENT

005D FB           273 HF1X2:   MOV     A,R3              ;CHECK FOR COIN DEPARTURE
005E 0303-04      274          ADD     A,#DPART1
0060 FD           275          MOV     A,R5
0061 E680         276          JNC     SCAN1    ;PULLCNT1 < DPART1? NO, EXIT
0063 53FE         277          ANL     A,#NOT ARR1       ;RESET ARR1
0065 4304         278          ORL     A,#DEPRT1         ;SET DEPRT1
0067 0479         279          JMP     HF1X5
                  280
                  281
0069 B929         282 HF1X3:   MOV     R1,#DATA1         ;Peak count res. HF1
006B FB           283          MOV     A,R3     ;COMPARE PULLCNT1 WITH PEAKCNT1
006C 61           284          ADD     A,@R1
006D F672         285          JC      HF1X4    ;PEAKCNT1 > PULLCNT1? YES, SKIP
006F FB           286          MOV     A,R3     ;MOVE PULLCNT1 TO PEAKCNT1
0070 37           287          CPL     A
0071 A1           288          MOV     @R1,A
                  289
                  290 ;SET ARR1 AND CHECK FOR DOUBLE ARRIVAL
                  291
0072 FD           292 HF1X4:   MOV     A,R5
0073 4341         293          ORL     A,#ARR1+DBLARR            ;SET ARR1,DBLARR
0075 5279         294          JB2     HF1X5                     ;DEPRT1=1? Y,EXIT
0077 53BF         295          ANL     A,#NOT DBLARR             ;RESET DBLARR
0079 AD           296 HF1X5:   MOV     R5,A
007A 0480         297          JMP     SCAN1
                  298
007C B925         299 CALHF1:  MOV     R1,#FSAVE1
007E 7423         300          CALL    CALIB
                  301
                  302 $EJECT
                  303
0080 8910         304 SCAN1:   ORL     P1,#HF2           ;Start HF2
0082 7400         305          CALL    CNTHF
                  306
                  307                                    ;PROCESS HF2 DATA
0084 B823         308 HF2X:    MOV     R0,#FUSE2
                  309
0086 FD           310          MOV     A,R5              ;CHECK RECALIBRATION
0087 F2CF         311          JB7     CALHF2            ;RECALIBRATION?
                  312
0089 743E         313 HF2X0:   CALL    SUBTR    ;REFCNT(@R0)-NEWCNT(R3,R4)=(R3,R4)
008B E698         314          JNC     HF2X3    ;NEWCNT2 >= REFCNT2? YES, CHK ARR
                  315
                  316                           ;If the pull is negative
                  317                                    ;CHECK FOR ESCROW RETURN
008D 03EB         318          ADD     A,#NOT ERTN1      ;Esc ret magnitude
008F FD           319          MOV     A,R5              ;Status register
0090 E694         320          JNC     HF2X1             ;PULLCNT2 >= ERTN2?
0092 2498         321          JMP     ESCROW            ;ESCROW return routine
                  322
0094 BBFF         323 HF2X1:   MOV     R3,#0FFH          ;NEGATIVE RESULT
0096 04A8         324          JMP     HF2X3A            ;CHECK DEPART if Arriv
                  325
                  326
                  327 HF2X3:                             ;If pull is positive
0098 0302         328          ADD     A,#EROFF          ;is it > Esc. ret. off
009A F6A4         329          JC      B2TST    ;If not so test for HF1 depart
009C FD           330          MOV     A,R5     ;If yes, reset ER status bit
009D 53DF         331          ANL     A,#NOT ERTN
009F AD           332          MOV     R5,A
00A0 B817         333          MOV     R0,#ERDTIM        ;Reset Esc Ret Def Timer
00A2 B000         334          MOV     @R0,#00H
00A4 52A8         335 B2TST:   JB2     HF2X3A   ;If HF1 Depart test HF2 Arrive
00A6 04D3         336          JMP     SCAN2    ;Otherwise exit
                  337
00A8 FB           338 HF2X3A:  MOV     A,R3              ;CHECK HF2 ARRIVAL
00A9 0306         339          ADD     A,#ARRIV2
00AB E6C0         340          JNC     HF2X5             ;PULLCNT2 >= ARRIV2? YES
                  341                                    ;COMPARE WITH PEAKCOUNT2
00AD FD           342          MOV     A,R5
00AE 32B2         343          JB1     HF2X4    ;ARR2=1? YES, CHECK DEPARTURE
00B0 04D3         344          JMP     SCAN2
                  345
00B2 FB           346 HF2X4:   MOV     A,R3     ;CHECK FOR COIN DEPARTURE
00B3 0303         347          ADD     A,#DPART2
00B5 FD           348          MOV     A,R5
00B6 E6D3         349          JNC     SCAN2    ;PULLCNT2 < DPART2? NO, EXIT
00B8 4308         350          ORL     A,#DEPRT2                 ;SET DEPRT2
00BA B816         351          MOV     R0,#CDDTIM        ;Reset the coin drop
00BC B000         352          MOV     @R0,#00           ;Default timer
00BE 04CC         353          JMP     HF2X7
                  354
                  355
00C0 B92A         356 HF2X5:   MOV     R1,#DATA2         ;Peakcount 2
00C2 FB           357          MOV     A,R3     ;COMPARE PULLCNT2 WITH PEAKCNT2
00C3 61           358          ADD     A,@R1
00C4 F6C9         359          JC      HF2X6    ;PEAKCNT2 > PULLCNT2? YES, SKIP
00C6 FB           360          MOV     A,R3     ;MOVE PULLCNT2 TO PEAKCNT2
00C7 37           361          CPL     A
00C8 A1           362          MOV     @R1,A
00C9 FD           363 HF2X6:   MOV     A,R5
00CA 4302         364          ORL     A,#ARR2                   ;SET ARR2=1
00CC AD           365 HF2X7:   MOV     R5,A
00CD 04D3         366          JMP     SCAN2
                  367
```

```
LOC  OBJ          SEQ          SOURCE STATEMENT

00CF B927          368 CALHF2: MOV     R1,#FSAVE2       ;REFCOUNT2
00D1 7423          369         CALL    CALIB
                   370
                   371 $EJECT
                   372
                   373 SCAN2:
00D3 FD            374 LF1:    MOV     A,R5     ;GET status
00D4 37            375         CPL     A        ;If HF1 depart test LF
00D5 52E3          376         JB2     LFCTST   ;otherwise skip to cal test
                   377
00D7 99BF          378         ANL     P1,#LFREF NOT    ;Enable LF phase
00D9 B82B          379         MOV     R0,#DATA3
00DB 7485          380         CALL    LFCNT
00DD 37            381         CPL     A
00DE 60            382         ADD     A,@R0    ;Add old peak
00DF F6E3          383         JC      LFCTST   ;old > new, so test cal cycle
00E1 FB            384 SAVNEW: MOV     A,R3
00E2 A0            385         MOV     @R0,A            ;New peak saved
                   386
00E3 FD            387 LFCTST: MOV     A,R5     ;Status register
00E4 F2F1          388         JB7     CALLF    ;Calibrate if B7 set
00E6 2438          389 JSCN3:  JMP     SCAN3
                   390
                   391
                   392
                   393
00E8 B9C8          394 TWOMS:  MOV     R1,#200D
00EA 00            395 TENUS:  NOP
00EB 00            396         NOP
00EC E9EA          397         DJNZ    R1,TENUS
00EE 83            398         RET
                   399
                   400
                   401
                   402
                   403
                   404
                   405
                   406
                   407
                   408
                   409
                   410
                   411
                   412
00F1               413         ORG     0F1H
                   414
                   415
00F1 8940          416 CALLF:  ORL     P1,#LFREF        ;Enable LF ref.
00F3 7485          417         CALL    LFCNT
00F5 B830          418         MOV     R0,#REFLF        ;Debug ram loc.
00F7 A0            419         MOV     @R0,A            ;Stored
                   420
                   421 ;Low Frequency limit Computations
                   422
00F8 D5            423 LFCOMP: SEL     RB1
00F9 0350          424         ADD     A,#175D NOT      ;Subtract 175
00FB 17            425         INC     A
00FC F6FF          426         JC      SAVEIT
00FE 27            427         CLR     A                ;If negative use zero
00FF AF            428 SAVEIT: MOV     R7,A
                   429
                   430 $EJECT
                   431
0100 B838          432 LFCMP1: MOV     R0,#LFLIM        ;Answers ram locations
0102 B9D4          433         MOV     R1,#CTABLE LOW   ;Computation DB list
                   434
0104 F9            435 COMPUT: MOV     A,R1     ;Get table address
0105 E3            436         MOVP3   A,@A     ;Get table value
0106 AD            437         MOV     R5,A     ;# of fractions in R5
0107 19            438         INC     R1       ;Next table address
                   439
0108 BB00          440         MOV     R3,#00H ;Quotiont low byte
010A BC00          441         MOV     R4,#00H ;Quotiont high byte
010C C624          442         JZ      ADCNST   ;Special case for nickels
                   443
010E F9            444 CMPT1:  MOV     A,R1     ;Get next table address
010F E3            445         MOVP3   A,@A     ;Get the value
0110 AE            446         MOV     R6,A     ;# of shifts in R6
0111 19            447         INC     R1
                   448
0112 BA00          449 DBLDIV: MOV     R2,#00H ;Divide to value in R7 by
0114 FF            450         MOV     A,R7     ;rotating right R6 times in
0115 97            451         CLR     C        ;double precision mannor
0116 67            452         RRC     A
0117 2A            453         XCH     A,R2
0118 67            454         RRC     A
0119 2A            455         XCH     A,R2
011A EE15          456         DJNZ    R6,DBLDIV +3
                   457
011C 2A            458 ADFRAC: XCH     A,R2     ;Add the resulting fraction
011D 6B            459         ADD     A,R3     ;to R3 & R4
011E AB            460         MOV     R3,A
```

```
LOC  OBJ          SEQ        SOURCE STATEMENT

011F FA            461        MOV     A,R2     ;High byte
0120 7C            462        ADDC    A,R4
0121 AC            463        MOV     R4,A
                   464
0122 EB0E          465        DJNZ    R5,CMPT1         ;Repeat R5 times
                   466
0124 F9            467 ADCNST: MOV    A,R1
0125 19            468        INC     R1
0126 E3            469        MOVP3   A,@A             ;Get the constant
0127 6C            470        ADD     A,R4             ;Add the quotient
                   471
0128 A0            472        MOV     @R0,A    ;Store the answer in LF limits
0129 18            473        INC     R0
012A F8            474        MOV     A,R0
012B D22F          475        JB6     ELFCMP
012D 2404          476        JMP     COMPUT
                   477
                   478
012F C5            479 ELFCMP: SEL    RB0
0130 FD            480        MOV     A,R5
0131 5330          481        ANL     A,#ERTN OR INHIB         ;Reset all else
0133 AD            482        MOV     R5,A
                   483
0134 B820          484        MOV     R0,#CALIBT
0136 B001          485        MOV     @R0,#CALTIM      ;Reset the calib. timer
                   486
                   487 $EJECT
                   488
                   489
0138 A5            490 SCAN3:  CLR    F1
0139 B817          491        MOV     R0,#ERDTIM
013B F0            492 DTLOOP: MOV    A,@R0    ;Decrement the default timers if
013C C656          493        JZ      NEXTDT   ;active. If the timer underflows
013E 07            494        DEC     A        ;Cause a restart with cal. cycle
013F A0            495        MOV     @R0,A
0140 9656          496        JNZ     NEXTDT
                   497
0142 B937 (5F)     498        MOV     R1,#CNMESS
0144 B11B          499        MOV     @R1,#CDDFLT      ;Coin drop default message
0146 764B          500        JF1     CLRDFT           ;Go clear the timers
0148 B117 (3F)     501        MOV     @R1,#ERDFLT      ;Esc. ret. default message
014A C8            502        DEC     R0
014B 27            503 CLRDFT: CLR    A
014C A0            504        MOV     @R0,A
014D 18            505        INC     R0
014E A0            506        MOV     @R0,A
014F F1            507        MOV     A,@R1    ;Acc. = coin mess for DSEND
0150 5482          508        CALL    DSEND
0152 54C5          509        CALL    XMTDBG
0154 042E          510        JMP     RESTRT -2
                   511
                   512
0156 B5            513 NEXTDT: CPL    F1
0157 C8            514        DEC     R0
0158 763B          515        JF1     DTLOOP
                   516
                   517
015A B820          518 CALTST: MOV    R0,#CALIBT       ;Calibration timer
015C FD            519        MOV     A,R5
015D 5325          520        ANL     A,#25H           ;If Arr1 or Dprt1 or ER
015F 9669          521        JNZ     DCODE            ;don't count cal. time
                   522
0161 F0            523        MOV     A,@R0
0162 10            524        INC     @R0
0163 9669          525        JNZ     DCODE            ;If zero set Cal flag
                   526
0165 FD            527 RECAL:  MOV    A,R5
0166 4380          528        ORL     A,#CALFLG        ;SET CALFLG
0168 AD            529        MOV     R5,A
                   530
                   531
0169 FD            532 DCODE:  MOV    A,R5
016A 5301          533        ANL     A,#01H   ;If AR1 is set start the
016C C675          534        JZ      DCODE1   ;coin drop default timer
016E B816          535        MOV     R0,#CDDTIM
0170 F0            536        MOV     A,@R0
0171 9675          537        JNZ     DCODE1   ;If running leave as is
0173 B0FF          538        MOV     @R0,#CDDT
0175 FD            539 DCODE1: MOV    A,R5     ;GET STATUS
0176 567E          540        JT1     AEUP     ;Accept enable is high
0178 9294          541        JB4     AELOW    ;Accept enable is low & INHIB=1
017A 72AB          542        JB3     XCOIN    ;If HF2 depart, Process coin
017C 0441          543        JMP     SCAN     ;NO ACTIVITY SO LOOP
                   544
                   545 $EJECT
                   546
                   547
                   548                         ;ROUTINE TO PROCESS DATA
017E 9292          549 AEUP:   JB4     SCNJMP           ;INHIB already =1
                   550
0180 4310          551        ORL     A,#INHIB         ;SET INHIBIT BIT
0182 AD            552        MOV     R5,A
                   553                                 ;Form Tube message
0183 744A          554        CALL    RDSENS           ;GET SENSORS
0185 FF            555        MOV     A,R7     ;Tube status
```

```
LOC  OBJ          SEQ          SOURCE STATEMENT

0186 5E           556          ANL     A,R6     ;Force bad=empty
0187 5307         557          ANL     A,#7     ;MASK LOWER SENSORS
0189 E7           558          RL      A        ;Rotate to position
018A E7           559          RL      A
018B 4323         560          ORL     A,#23H           ;ADD CNTRL BITS
018D B837         561          MOV     R0,#CNMESS
018F A0           562          MOV     @R0,A
0190 54AB         563          CALL    SENDIT
0192 0441         564 SCNJMP:  JMP     SCAN
                  565
                  566
0194 5320         567 AELOW:   ANL     A,#ERTN ;AE has gone low reset all status
0196 24A8         568          JMP     JMPRS   ;except Escro return
                  569
                  570
                  571                          ;ESCROW RETURN ROUTINE
0198 FD           572 ESCROW:  MOV     A,R5    ;Get the status register
0199 B29F         573          JB5     EXTESC  ;If Esc Ret bit set exit
                  574
019B 237E         575          MOV     A,#ESCRET        ;Escro return message
019D 5482         576          CALL    DSEND            ;SEND MESSAGE
                  577
019F B817         578 EXTESC:  MOV     R0,#ERDTIM       ;Start the default timer
01A1 B0FF         579          MOV     @R0,#ERDT
01A3 FD           580          MOV     A,R5
01A4 5310         581          ANL     A,#INHIB         ;Reset all except Inhibit
01A6 43A0         582          ORL     A,#ERTN OR CALFLG        ;Set ER & Calib
01A8 AD           583 JMPRS:   MOV     R5,A
01A9 0430         584          JMP     RESTRT
                  585
                  586
                  587 $EJECT
                  588                                   ;COIN PROCESSING
01AB 37           589 XCOIN:   CPL     A
01AC D2B2         590          JB6     XCOIN1           ;DBLARR? NO, Continue
01AE 2333         591          MOV     A,#DBLCN
01B0 4458         592          JMP     CDSEND           ;Yes, xmit debus & message
                  593
01B2 744A         594 XCOIN1:  CALL    RDSENS  ;Update the coin tube status
                  595
01B4 B82C         596 KOIN:    MOV     R0,#COIN1        ;Coinword 1
01B6 B929         597          MOV     R1,#DATA1        ;PEAKcount 1
01B8 BAB4         598          MOV     R2,#LOW DATABL   ;DATA TABLE
01BA 749C         599          CALL    VALUE   ;CONVERT PEAKCOUNT1 TO COINWORD1
01BC 18           600          INC     R0               ;Coinword 2
01BD 749C         601          CALL    VALUE   ;CONVERT PEAKCOUNT2 TO COINWORD2
                  602
01BF B838         603 LFVAL:   MOV     R0,#LFLIM        ;LF lower limit in ram
01C1 BAF7         604          MOV     R2,#RTABLE LOW   ;LF range DB list address
01C3 BB80         605          MOV     R3,#80H ;CLEAR BUFFER, SET PILOT BIT
01C5 F0           606 LFVAL1:  MOV     A,@R0   ;Lower limit
01C6 37           607          CPL     A
01C7 17           608          INC     A
01C8 61           609          ADD     A,@R1   ;Subtracted from peakcount
01C9 E6D1         610          JNC     LFVAL2  ;Peak>=Lowlimit? NO, RESET BIT
                  611
01CB FA           612          MOV     A,R2
01CC E3           613          MOVP3   A,@A    ;Range value
01CD 60           614          ADD     A,@R0   ;+ lowlimit = high limit
01CE 37           615          CPL     A       ;Peak-highlimit
01CF 61           616          ADD     A,@R1
01D0 A7           617          CPL     C       ;C=0 IMPLIES NO MATCH
01D1 FB           618 LFVAL2:  MOV     A,R3    ;SAVE COIN BIT
01D2 67           619          RRC     A
01D3 AB           620          MOV     R3,A
01D4 1A           621          INC     R2      ;Next range value
01D5 18           622          INC     R0      ;Next lowlimit
01D6 E6C5         623          JNC     LFVAL1  ;DONE? NO, LOOP
01D8 B82E         624          MOV     R0,#COIN3
01DA A0           625          MOV     @R0,A   ;SAVE COINWORD
                  626
01DB B92C         627 KOINO:   MOV     R1,#COIN1                ;COMBINE COINWORDS
01DD F1           628          MOV     A,@R1
01DE 19           629          INC     R1
01DF 51           630          ANL     A,@R1
01E0 19           631          INC     R1
01E1 51           632          ANL     A,@R1
01E2 AC           633          MOV     R4,A    ;SAVE COINWORD COMBINATION
                  634
01E3 0A           635          IN      A,P2
01E4 52EA         636          JB2     KOIN1   ;Jump if U.S. only
01E6 FC           637          MOV     A,R4    ;If US/Can combine nibbles
01E7 47           638          SWAP    A
01E8 4C           639          ORL     A,R4
01E9 AC           640          MOV     R4,A
                  641
01EA FC           642 KOIN1:   MOV     A,R4    ;Get combined coinword
01EB 530F         643          ANL     A,#0FH
01ED 96F3         644          JNZ     KOIN2   ;INVALID COIN? NO, continue
01EF 237B         645          MOV     A,#SLUG
01F1 4458         646          JMP     CDSEND  ;Go send slug & debug info
                  647
01F3 BBFF         648 KOIN2:   MOV     R3,#0FFH         ;DETERMINE COIN VALUE
```

```
LOC  OBJ          SEQ        SOURCE STATEMENT

01F5 1B            649 KOIN3:  INC     R3
01F6 67            650         RRC     A
01F7 E6F5          651         JNC     KOIN3            ;FINISHED? NO, LOOP
                   652
                   653 ;R4=Linear 'coin value' b0=D b1=q b2=d b3=n
                   654 ;R3=Binary 'coin value' 00=D 01=q 02=d 03=n
                   655
01F9 B837          656 KOIN4:  MOV     R0,#CNMESS       ;Coin message ram loc
01FB FB            657         MOV     A,R3
01FC 47            658         SWAP    A
01FD E7            659         RL      A
01FE 5360          660         ANL     A,#60H           ;Coin bits set in acc.
0200 A0            661         MOV     @R0,A    ;Coin bits set in message reg.
                   662
0201 FF            663 KOIN5:  MOV     A,R7     ;Get cointube status
0202 5E            664         ANL     A,R6     ;Combine with bad sensor status
0203 E7            665         RL      A
0204 E7            666         RL      A        ;Rotate to position
0205 531C          667         ANL     A,#1CH   ;Masked
0207 40            668         ORL     A,@R0
0208 A0            669         MOV     @R0,A    ;Added to the coin message
                   670
                   671
0209 85            672 DESTIN: CLR     F0       ;F0 reset = coin to inv tubes
020A FF            673         MOV     A,R7     ;Sensor status
020B 37            674         CPL     A        ;Uncovered = 1
020C 5E            675         ANL     A,R6     ;(R6=bad) Uncov. and good= 1
020D AA            676         MOV     R2,A     ;Save it
020E FC            677         MOV     A,R4
020F 122A          678         JB0     DOLLAR
0211 3221          679         JB1     QUARTR
                   680
0213 FC            681 HILEV:  MOV     A,R4     ;Get coinword again
0214 E7            682         RL      A        ;Arrange to match tube status
0215 E7            683         RL      A
0216 5A            684         ANL     A,R2     ;Uncov.+good+the one of interest
0217 5338          685         ANL     A,#38H   ;Mask off all else
0219 C637          686         JZ      BOX
                   687
021B 2301          688 INVEN:  MOV     A,#01H   ;Inventory bit in coin message
021D 40            689         ORL     A,@R0
021E A0            690         MOV     @R0,A
021F 4438          691         JMP     TSTSTB   ;Go test for stuck strobe
                   692
                   693
0221 0A            694 QUARTR: IN      A,P2     ;Get the option switch
0222 37            695         CPL     A
0223 3213          696         JB1     HILEV
0225 FA            697 LOLEV:  MOV     A,R2
0226 121B          698         JB0     INVEN    ;Low level uncovered + good
0228 4437          699         JMP     BOX
                   700
022A FF            701 DOLLAR: MOV     A,R7     ;cointube sensor status
022B 5E            702         ANL     A,R6     ;Bad sensor status
022C 1232          703         JB0     TSTOSW   ;If sensor good and covered
                   704                          ;go test the $ option switch
022E 2313          705 DREJCT: MOV     A,#DCDFLT        ;Otherwise send the
0230 4458          706         JMP     CDSEND           ;DOLLAR Default message
                   707
                   708
                   709
0232 0A            710 TSTOSW: IN      A,P2
0233 37            711         CPL     A
0234 122E          712         JB0     DREJCT
0236 B5            713         CPL     F1       ;Set F1 for G1 timing
                   714
0237 95            715 BOX:    CPL     F0       ;Coin headed to cashbox
                   716                          ;NO change to coin message
                   717
0238 747C          718 TSTSTB: CALL    STROBE
023A B82F          719         MOV     R0,#STROB
023C FB            720         MOV     A,R3
023D A0            721         MOV     @R0,A    ;Stored for debug xmit
023E E644          722         JNC     AETST    ;If strobe ok so test AE
                   723
0240 2337          724 JAM:    MOV     A,#STBJAM        ;JAMMED STROBE
0242 4458          725         JMP     CDSEND
                   726
0244 5680          727 AETST:  JT1     RSJMP            ;Exit for no AE
                   728
                   729
                   730 $EJECT
                   731
                   732 ;F0 indicates cashbox/inventory  (1/0)
                   733 ;F1 is expected set for dollar coin
                   734 ;
                   735 ;Energise gates as directed.
                   736 ;De-energise G1 02ms (20 for F1 set) after strobe or
                   737 ;after 240ms if no strobe. De-energise G2 350ms after
                   738 ;G1 or at nostrobe. Transmit coin message if all ok.
                   739
                   740
```

```
LOC  OBJ.   SEQ        SOURCE STATEMENT

0246 9AF7   741 GATES:  ANL     P2,#GATE1 NOT    ;Energise gate 1
0248 B64C   742         JF0     STRTST           ;If F0 set no G2
024A 9AEF   743         ANL     P2,#GATE2 NOT    ;Energise gate 2
            744
024C B9F0   745 STRTST: MOV     R1,#240D         ;240 times thru strobe
            746                                  ;~= 240ms
024E 747C   747 GATEA:  CALL    STROBE
0250 F65E   748         JC      FSTRBE           ;Jump if strobe
0252 E94E   749         DJNZ    R1,GATEA
            750
0254 8A18   751         ORL     P2,#GATE1 OR GATE2
0256 237F   752 NSTROB: MOV     A,#NOSTRB
0258 5482   753 CDSEND: CALL    DSEND            ;Set HiLow bit & XMIT
025A BA00   754         MOV     R2,#00H
025C 4477   755         JMP     XMITM +2         ;Xmit debug & restart
            756
025E B80A   757 FSTRBE: MOV     R0,#10D          ;10*2ms=20ms for Dollar
0260 7664   758         JF1     CAL2MS
0262 B801   759         MOV     R0,#01D          ;01*2ms =02ms for others
            760
0264 14E8   761 CAL2MS: CALL    TWOMS
0266 E864   762         DJNZ    R0,CAL2MS
            763
0268 8A08   764         ORL     P2,#GATE1        ;De-energise GATE 1
            765
026A BA00   766 GATEB:  MOV     R2,#00H          ;Used by end of gate B
026C B675   767         JF0     XMITM            ;Go transmit messages
            768
026E BA12   769         MOV     R2,#18D          ;17*20ms + 1*10ms=350ms
0270 237F   770         MOV     A,#7FH
0272 62     771         MOV     T,A
0273 55     772         STRT    T
0274 25     773         EN      TCNTI    ;Timer overflow will dec R2
            774
0275 548D   775 XMITM:  CALL    SEND0    ;Send the coin message
            776
0277 54C5   777         CALL    XMTDBG   ;Send the debug info
            778
0279 FA     779 TSTR2:  MOV     A,R2     ;Wait til timer dec's R2
027A 9679   780         JNZ     TSTR2    ;to zero and de-energizes G2
            781
027C B820   782         MOV     R0,#CALIBT
027E B001   783         MOV     @R0,#CALTIM      ;Restart the cal timer
            784
0280 0430   785 RSJMP:  JMP     RESTRT
            786
            787 $EJECT
            788
            789
            790
            791 ;Default message send routine
            792 ;The acc. is expected to contain the base message
            793 ;The HI/LO bit will be added here
            794
0282 B837   795 DSEND:  MOV     R0,#CNMESS       ;Message ram location
0284 A0     796         MOV     @R0,A
0285 0A     797         IN      A,P2
0286 37     798         CPL     A
0287 328D   799         JB1     SEND0    ;If op.sw.=1 send mess. as is
0289 23EF   800         MOV     A,#10H NOT       ;Otherwise reset the
028B 50     801         ANL     A,@R0            ;HI/LO bit
028C A0     802         MOV     @R0,A
            803
028D 9ABF   804 SEND0:  ANL     P2,#INTR NOT     ;Drop the interupt request
            805
028F BC0A   806         MOV     R4,#10D          ;Debounce count
0291 0A     807 SENDWT: IN      A,P2
0292 B291   808         JB5     SENDWT
0294 EC91   809         DJNZ    R4,SENDWT
            810
0296 54AB   811         CALL    SENDIT
            812
0298 BC39   813         MOV     R4,#57D          ;Looking for send to
029A 0A     814 SNDWT1: IN      A,P2             ;so high for at least
029B 37     815         CPL     A                ;1ms
029C B29A   816         JB5     SNDWT1
029E EC9A   817         DJNZ    R4,SNDWT1
            818
02A0 BCCA   819         MOV     R4,#202D         ;Looking for send to
02A2 0A     820 SNDWT2: IN      A,P2             ;so low within 3.5ms
02A3 37     821         CPL     A
02A4 B291   822         JB5     SENDWT
02A6 ECA2   823         DJNZ    R4,SNDWT2
02A8 8A40   824         ORL     P2,#INTR         ;Raise interupt
02AA 83     825         RET
            826
            827
02AB B837   828 SENDIT: MOV     R0,#CNMESS
02AD BC0A   829         MOV     R4,#0AH
02AF 97     830         CLR     C
02B0 A7     831         CPL     C                ;Carry = stop bit
02B1 44B8   832         JMP     SNDZRO           ;Send the start bit
            833
02B3 F0     834 SENDLP: MOV     A,@R0
```

```
LOC  OBJ          SEQ        SOURCE STATEMENT

02B4 67                 RRC     A
02B5 A0                 MOV     @R0,A
02B6 F6BC               JC      SNDONE
02B8 9A7F       SNDZRO: ANL     P2,#DATA NOT
02BA 44BE               JMP     B600
02BC 8A80       SNDONE: ORL     P2,#DATA
02BE B9A4       B600:   MOV     R1,#164D
02C0 14EA               CALL    TENUS
02C2 ECB3               DJNZ    R4,SENDLP
02C4 83                 RET


$EJECT


;Transmit the debug info thru the Data Pin

02C5 B83F       XMTDBG: MOV     R0,#3FH         ;Top of ram
02C7 BB1B               MOV     R3,#27D         ;27 bytes to send

02C9 F0         XMTLOP: MOV     A,@R0   ;Get byte
02CA 47                 SWAP    A
02CB 54DF               CALL    HEXASC  ;Convert & xmit the high nibble
02CD F0                 MOV     A,@R0
02CE 54DF               CALL    HEXASC  ;Convert & xmit the low nibble
02D0 2320               MOV     A,#' '  ;Space
02D2 54E8               CALL    XMTACC
02D4 C8                 DEC     R0
02D5 EBC9               DJNZ    R3,XMTLOP

02D7 230D               MOV     A,#0DH  ;'CR'
02D9 54E8               CALL    XMTACC
02DB 230A               MOV     A,#0AH  ;'LF'
02DD 44E8               JMP     XMTACC


02DF 530F       HEXASC: ANL     A,#0FH
02E1 0330               ADD     A,#30H
02E3 57                 DA      A
02E4 D2E7               JB6     ADD1
02E6 07                 DEC     A
02E7 17         ADD1:   INC     A

02E8 BC0A       XMTACC: MOV     R4,#0AH
02EA 97                 CLR     C
02EB A7                 CPL     C               ;Carry = stop bit
02EC 44F1               JMP     SND0            ;Send the start bit

02EE 67         XMTALP: RRC     A
02EF F6F5               JC      SND1
02F1 9AF8       SND0:   ANL     P2,#07 NOT
02F3 44F7               JMP     BAUD
02F5 8A07       SND1:   ORL     P2,#07
02F7 B911       BAUD:   MOV     R1,#17D         ;7=9600, 17=4800, 37=2400
02F9 14EA               CALL    TENUS
02FB ECEE               DJNZ    R4,XMTALP
02FD 83                 RET


$EJECT
0300                    ORG     300H

;~~~~~~~~~~~~~~~~System subroutines~~~~~~~~~~~~~~~~~~~~

;Count the high frequency oscilators
;HFx is assumed running
;Hard. counter is assumed reset

0300 BA19       CNTHF:  MOV     R2,#25D         ;Kill 125us while the
0302 EA02       CNTHF1: DJNZ    R2,CNTHF1       ;osc. stablizes

0304 65                 STOP    TCNT

0305 997F               ANL     P1,#RST NOT     ;Start the hard counter
0307 23F4               MOV     A,#ITIME        ;Timer will overflow
0309 62                 MOV     T,A             ;960 us after strt T
030A 25                 EN      TCNTI
030B 55                 STRT    T

030C BCFF               MOV     R4,#0FFH        ;Overflow counter

030E 08         B7HIGH: INS     A,BUS
030F 161B               JTF     OVRTST          ;One last overflow test
0311 F20E               JB7     B7HIGH
0313 1C                 INC     R4
0314 08         B7LOW:  INS     A,BUS
0315 161F               JTF     DONE
0317 F20E               JB7     B7HIGH
0319 6414               JMP     B7LOW
```

```
LOC  OBJ          SEQ        SOURCE STATEMENT

031B 08            928 OVRTST: INS     A,BUS    ;If the MSB was high @ Int. Test
031C F21F          929         JB7     DONE     ;for new overflow.
031E 1C            930         INC     R4
031F 65            931 DONE:   STOP    TCNT
0320 35            932         DIS     TCNTI
0321 6495          933         JMP     READ     ;Go read bus & restore P1
                   934
                   935
                   936
                   937
                   938
                   939
                   940 ;UPDATE REFCOUNT
                   941
0323 FB            942 CALIB:  MOV     A,R3     ;MOVE NEWCOUNT TO REFCOUNT
0324 A1            943         MOV     @R1,A
0325 19            944         INC     R1
0326 FC            945         MOV     A,R4
0327 A1            946         MOV     @R1,A
                   947
0328 FB            948         MOV     A,R3     ;COMPARE SAVECOUNT WITH NEWCOUNT
0329 37            949         CPL     A
032A 60            950         ADD     A,@R0
032B 18            951         INC     R0
032C FC            952         MOV     A,R4
032D 37            953         CPL     A
032E 70            954         ADDC    A,@R0
032F F638          955         JC      CAL0     ;SAVECNT > NEWCNT? YES,SKIP
                   956
0331 F0            957         MOV     A,@R0    ;MOVE SAVECOUNT TO REFCOUNT
0332 A1            958         MOV     @R1,A
0333 C8            959         DEC     R0
0334 C9            960         DEC     R1
0335 F0            961         MOV     A,@R0
0336 A1            962         MOV     @R1,A
0337 18            963         INC     R0
                   964
0338 FC            965 CAL0:   MOV     A,R4     ;MOVE NEWCOUNT TO SAVECOUNT
0339 A0            966         MOV     @R0,A
033A C8            967         DEC     R0
033B FB            968         MOV     A,R3
033C A0            969         MOV     @R0,A
033D 83            970         RET
                   971
                   972 $EJECT
                   973
033E FB            974 SUBTR:  MOV     A,R3     ;SUBTRACT NEWCNT FROM REFCNT
033F 37            975         CPL     A
0340 17            976         INC     A
0341 60            977         ADD     A,@R0
0342 AB            978         MOV     R3,A
0343 FC            979         MOV     A,R4
0344 37            980         CPL     A
0345 18            981         INC     R0
0346 70            982         ADDC    A,@R0
0347 AC            983         MOV     R4,A
0348 FB            984         MOV     A,R3
0349 83            985         RET
                   986
                   987
                   988
                   989 ;ROUTINE TO READ COIN TUBE SENSORS
                   990
034A BEFF          991 RDSENS: MOV     R6,#0FFH         ;Set bad res. = good
034C BB06          992         MOV     R3,#06H          ;# of reads
034E BA20          993         MOV     R2,#20H          ;Seed bit
0350 B831          994         MOV     R0,#TUBES        ;Ram loc to save counts
                   995
0352 FB            996 RSLOOP: MOV     A,R3             ;Sensor address
0353 17            997         INC     A
0354 39            998         OUTL    P1,A     ;Starts osc. & counter
                   999
0355 14E8         1000         CALL    TWOMS    ;Wait 2 ms
                  1001
0357 08           1002         INS     A,BUS            ;READ COUNTER
0358 A0           1003         MOV     @R0,A    ;Save the count for debug
                  1004
0359 03FB         1005 SENT1:  ADD     A,#(05D -1) NOT ;Test for bad sensor
035B F663         1006         JC      SENT2
035D FA           1007 BADSEN: MOV     A,R2
035E 37           1008         CPL     A
035F 5E           1009         ANL     A,R6     ;Bad sensor bit on in R6
0360 AE           1010         MOV     R6,A
0361 646F         1011         JMP     EMTSEN
                  1012
0363 03E2         1013 SENT2:  ADD     A,#(30D -1) NOT ;Test for covered
0365 F66B         1014         JC      SENT3            ;Jump if not covered
0367 FA           1015 COVSEN: MOV     A,R2
0368 4F           1016         ORL     A,R7     ;Covered bit on in R7
0369 6472         1017         JMP     R7MOVE
                  1018
036B 03FB FD      1019 SENT3:  ADD     A,#(05D -1) NOT ;Test for uncovered
036D E673         1020         JNC     NXTSEN           ;No change
036F FA           1021 EMTSEN: MOV     A,R2
0370 37           1022         CPL     A
```

```
LOC  OBJ          SEQ          SOURCE STATEMENT

0371 5F           1023          ANL     A,R7
0372 AF           1024 R7MOVE:  MOV     R7,A
                  1025
0373 FA           1026 NXTSEN:  MOV     A,R2
0374 77           1027          RR      A
0375 AA           1028          MOV     R2,A
0376 7497         1029          CALL    P1SET          ;Set P1 to normal state
0378 18           1030          INC     R0      ;Set for next sensor
0379 EB52         1031          DJNZ    R3,RSLOOP
                  1032
037B 83           1033          RET
                  1034
                  1035
                  1036
037C 00           1037 STROBE:  NOP
037D 8920         1038          ORL     P1,#STRBE      ;Start strobe osc.
037F 7400         1039          CALL    CNTHF
0381 FB           1040          MOV     A,R3    ;Get lowcount
0382 0386         1041          ADD     A,#121D NOT
0384 83           1042          RET                    ;Carry means strobe
                  1043
                  1044
                  1045 $EJECT
                  1046
0385 8685         1047 LFCNT:   JNI     LFCNT   ;If low wait till high
                  1048
0387 868B         1049 LFC1:    JNI     SLFCNT  ;Start LF count when Int. low
0389 6487         1050          JMP     LFC1
                  1051
038B 997F         1052 SLFCNT:  ANL     P1,#RST NOT     ;Start the counter
038D 8901         1053          ORL     P1,#01H        ;Decoder = 01
                  1054
038F 868F         1055 LFC3:    JNI     LFC3    ;Wait here while low
                  1056
0391 8695         1057 LFC4:    JNI     READ    ;When low back low
0393 6491         1058          JMP     LFC4
                  1059
0395 08           1060 READ:    INS     A,BUS
0396 AB           1061          MOV     R3,A    ;Temp. save
0397 89C0         1062 P1SET:   ORL     P1,#0C0H       ;Reset Port one
0399 99C0         1063          ANL     P1,#03FH NOT   ;To the normal state
039B 83           1064          RET
                  1065
                  1066
                  1067
                  1068
                  1069
                  1070 ;COMPARE PEAKDATA WITH COIN TABLES
                  1071 ;USE R3 AS COIN BUFFER
                  1072
039C BB80         1073 VALUE:   MOV     R3,#80H ;CLEAR BUFFER, SET PILOT BIT
039E FA           1074 VAL1:    MOV     A,R2
039F E3           1075          MOVP3   A,@A    ;GET LOTAB(N,I)
03A0 37           1076          CPL     A       ;DATA(I)-LOTAB(N,I)
03A1 17           1077          INC     A
03A2 61           1078          ADD     A,@R1
03A3 1A           1079          INC     R2      ;GET HITAB(N,I)
03A4 E6AB         1080          JNC     VAL2    ;DATA(I)>=LOTAB(N,I)? NO,RST BIT
03A6 FA           1081          MOV     A,R2
03A7 E3           1082          MOVP3   A,@A
03A8 37           1083          CPL     A       ;DATA(I)-HITAB(N,I)
03A9 61           1084          ADD     A,@R1
03AA A7           1085          CPL     C       ;C=0 IMPLIES NO MATCH
03AB FB           1086 VAL2:    MOV     A,R3    ;SAVE COIN BIT
03AC 67           1087          RRC     A
03AD AB           1088          MOV     R3,A
03AE 1A           1089          INC     R2      ;LOTAB(N+1,I)
03AF E69E         1090          JNC     VAL1    ;DONE? NO, LOOP
03B1 A0           1091          MOV     @R0,A   ;SAVE COINWORD
03B2 19           1092          INC     R1      ;Increment to next DATA reg.
03B3 83           1093          RET
                  1094
                  1095
                  1096
                  1097
                  1098 $EJECT
                  1099 ;BEGINING OF DATA TABLES
                  1100
                  1101 DATABL:                         ;HF1 Table
03B4 9C           1102          DB      156,196        ;U.S. Dollar
03B5 C4
                  1103
03B6 6A           1104          DB      106,140        ;U.S. Quarter
03B7 8C
                  1105
03B8 08           1106          DB      08,20          ;U.S. Dime
03B9 14 1A                                26
                  1107
03BA 28 26        1108          DB      40,72          ;U.S. Nickel
03BB 48 50                                38 80
                  1109
03BC 00           1110          DB      0,0            ;Canadian Dollar
03BD 00
                  1111
03BE 50           1112          DB      80,116         ;Canadian Quarter
03BF 74
```

```
LOC  OBJ          SEQ          SOURCE STATEMENT

                  1113
03C0 07           1114         DB      7,20                ;Canadian Dime
03C1 14 10                                 16
                  1115
03C2 23           1116         DB      35,66               ;Canadian Nickel
03C3 42
                  1117
                  1118
                  1119                                     ;HF2 Table
03C4 40           1120         DB      64,79               ;U.S. Dollar
03C5 4F
                  1121
03C6 2D           1122         DB      45,62               ;U.S. Quarter
03C7 3E
                  1123
03C8 1C           1124         DB      28,45               ;U.S. Dime
03C9 2D 2F                                 47
                  1125
03CA 37           1126         DB      55,80               ;U.S. Nickel
03CB 50
                  1127
03CC 00           1128         DB      0,0                 ;Canadian Dollar
03CD 00
                  1129
03CE 12           1130         DB      18,45               ;Canadian Quarter
03CF 2D
                  1131
03D0 06           1132         DB      6,25                ;Canadian Dime
03D1 19
                  1133
03D2 1E 19        1134         DB      30,52               ;Canadian Nickel
03D3 34                                    25
                  1135
                  1136 $EJECT
                  1137
                  1138 ;LF limits computation table
                  1139
03D4 03           1140 CTABLE: DB      03,6,4,3,(97-7)             ;U.S. Dollar
03D5 06
03D6 04                                        ~~92~~
03D7 03                                           98
03D8 5A 50 58
                  1141
03D9 03           1142         DB      03,6,4,3,(101-7)            ;U.S. Quarter
03DA 06
03DB 04                                        96
03DC 03
03DD 5E 60 5A
                  1143
03DE 04           1144         DB      04,7,6,4,3,(87-7)           ;U.S. Dime
03DF 07                                        ~~83~~
03E0 06
03E1 04                                           73
03E2 03
03E3 50 53 4E
                  1145
03E4 00           1146         DB      00,(29-6)                   ;U.S. Nickel
03E5 17
                  1147
03E6 00           1148         DB      00,0                        ;Can. Dollar
03E7 00
                  1149
03E8 04           1150         DB      04,5,4,3,2,(130-20)         ;Can. Quarter
03E9 05
03EA 04                                        105
03EB 03
03EC 02
03ED 6E 69
                  1151
03EE 03           1152         DB      03,6,4,3,(89-19)            ;Can. Dime
03EF 06
03F0 04                                        74
03F1 03
03F2 46 4A
                  1153
03F3 02           1154         DB      02,7,2,(119-23)             ;Can. Nickel
03F4 07                                        ~~96~~
03F5 02
03F6 60
                  1155
                  1156 ;LF range values
                  1157
03F7 0E 0F        1158 RTABLE: DB      14,15,14,13,0,40,38,47
03F8 0F                                        50 35 55
03F9 0E 0F
03FA 0D
03FB 00
03FC 28 32
03FD 26 23
03FE 2F 37
                  1159
                  1160 $EJECT
                  1161
                  1162
```

```
USER SYMBOLS
ADCNST 0124    ADD1   02E7    ADFRAC 011C    ADR0   0001    ADR1   0002
ADR2   0004    AELOW  0194    AETST  0244    AEUP   017E    ARR1   0001
ARR2   0002    ARRIV1 0008    ARRIV2 0006    B2TST  00A4    B600   02BE
B7HIGH 030E    B7LOW  0314    BADSEN 035D    BAUD   02F7    BEGIN  0000
BOX    0237    CALO   0338    CAL2MS 0264    CALFLG 0080    CALHF1 007C
CALHF2 00CF    CALIB  0323    CALIBT 0020    CALLF  00F1    CALTIM 0001
CALTST 015A    CDDFLT 001B    CDDT   00FF    CDDTIM 0016    CDSEND 0258
CLRDFT 014B    CLRLP  003A    CLRRAM 0014    CMPT1  010E    CNMESS 0037
CNTHF  0300    CNTHF1 0302    COIN1  002C    COIN2  002D    COIN3  002E
COMPUT 0104    COVSEN 0367    CTABLE 03D4    DATA   0080    DATA1  0029
DATA2  002A    DATA3  002B    DATABL 03B4    DBLARR 0040    DBLCN  0033
DBLDIV 0112    DCDFLT 0013    DCODE  0169    DCODE1 0175    DEPRT1 0004
DEPRT2 0008    DESTIN 0209    DFCTIV 0077    DLRSW  0001    DOLLAR 022A
DONE   031F    DPART1 0003    DPART2 0003    DREJCT 022E    DSEND  02B2
DTLOOP 013B    ELFCMP 012F    EMTSEN 036F    ERDFLT 0017    ERDT   00FF
ERDTIM 0017    EROFF  0002    ERTN   0020    ERTN1  0014    ESCRET 007E
ESCROW 0198    EXG2   0012    EXTESC 019F    FSAVE1 0025    FSAVE2 0027
FSTRBE 025E    FUSE1  0021    FUSE2  0023    GATE1  0008    GATE2  0010
GATEA  024E    GATEB  026A    GATES  0246    HEXASC 02DF    HF1    0008
HF1X   0046    HF1X0  004B    HF1X1  0053    HF1X2  005D    HF1X3  0069
HF1X4  0072    HF1X5  0079    HF1XA  0051    HF2    0010    HF2X   0084
HF2X0  0089    HF2X1  0094    HF2X3  0098    HF2X3A 00A8    HF2X4  00B2
HF2X5  00C0    HF2X6  00C9    HF2X7  00CC    HILEV  0213    HILOSW 0002
INHIB  0010    INTR   0040    INVEN  021B    ITIME  00F4    JAM    0240
JMPRS  01A8    JSCN3  00E6    KOIN   01B4    KOIN0  01DB    KOIN1  01EA
KOIN2  01F3    KOIN3  01F5    KOIN4  01F9    KOIN5  0201    LF1    00D3
LFC1   0387    LFC3   038F    LFC4   0391    LFCMP1 0100    LFCNT  0385
LFCOMP 00F8    LFCTST 00E3    LFLIM  0038    LFREF  0040    LFVAL  01BF
LFVAL1 01C5    LFVAL2 01D1    LOLEV  0225    NEXTDT 0156    NOSTRB 007F
NSTROB 0256    NXTSEN 0373    OVRTST 031B    P1SET  0397    PWRUP  0073
QUARTR 0221    R7MOVE 0372    RDSENS 034A    READ   0395    RECAL  0165
REFLF  0030    RESTRT 0030    RSJMP  0280    RSLOOP 0352    RST    0080
RTABLE 03F7    SAVEIT 00FF    SAVNEW 00E1    SCAN   0041    SCAN1  0080
SCAN2  00D3    SCAN3  0138    SCNJMP 0192    SEND   0020    SENDO  028D
SENDIT 02AB    SENDLP 02B3    SENDWT 0291    SENT1  0359    SENT2  0363
SENT3  036B    SLFCNT 038B    SLUG   007B    SNDO   02F1    SND1   02F5
SNDONE 02BC    SNDWT1 029A    SNDWT2 02A2    SNDZRO 02B8    STARTO 0001
STBJAM 0037    STBTST 024C    STRBE  0020    STROB  002F    STROBE 037C
SUBTR  033E    TENUS  00EA    TINTR  0007    TSTOSW 0232    TSTR2  0279
TSTSTB 0238    TUBES  0031    TWOMS  00E8    USCSW  0004    VAL1   039E
VAL2   03AB    VALUE  039C    XCOIN  01AB    XCOIN1 01B2    XMITM  0275
XMTACC 02E8    XMTALP 02EE    XMTDBG 02C5    XMTLOP 02C9

ASSEMBLY COMPLETE,  NO ERRORS

ISIS-II ASSEMBLER SYMBOL CR    REFERENCE, V2.1

ADCNST   442     467#
ADD1     877     879#
ADFRAC   458#
ADR0      69#
ADR1      70#
ADR2      71#
AELOW    541     567#
AETST    722     727#
AEUP     540     549#
ARR1     101#    277     293
ARR2     102#    364
ARRIV1   110#    265
ARRIV2   111#    339
B2TST    329     335#
B600     839     841#
B7HIGH   919#    921     925
B7LOW    923#    926
BADSEN  1007#
BAUD     889     891#
BEGIN    183#
BOX      686     699     715#
CALO     955     965#
CAL2MS   758     761#    762
CALFLG   108#    236     528     582
CALHF1   257     299#
CALHF2   311     368#
CALIB    300     369     942#
CALIBT   138#    484     518     782
CALLF    388     416#
CALTIM    96#    485     783
CALTST   518#
CDDFLT   127#    499 ←
CDDT      98#    538
CDDTIM   159#    351     535
CDSEND   592     646     706     725     753#
CLRDFT   500     503#
CLRLP    243#    245
CLRRAM   187     205#    207
CMPT1    444#    465
CNMESS   153#    498     561     656     795     828
CNTHF    251     305     906#   1039
CNTHF1   907#    907
COIN1    147#    596     627
COIN2    148#
COIN3    149#    624
COMPUT   435#    476
```

ISIS-II ASSEMBLER SYMBOL CRL REFERENCE, V2.1

| | | | | | | |
|---|---|---|---|---|---|---|
| COVSEN | 1015# | | | | | |
| CTABLE | 433 | 1140# | | | | |
| DATA | 87# | 838 | 840 | | | |
| DATA1 | 144# | 241 | 282 | 597 | | |
| DATA2 | 145# | 356 | | | | |
| DATA3 | 146# | 379 | | | | |
| DATABL | 598 | 1101# | | | | |
| DBLARR | 107# | 293 | 295 | | | |
| DBLCN | 129# | 591 | | | | |
| DBLDIV | 449# | 456 | | | | |
| DCDFLT | 125# | 705 | | | | |
| DCODE | 521 | 525 | 532# | | | |
| DCODE1 | 534 | 537 | 539# | | | |
| DEFRT1 | 103# | 278 | | | | |
| DEFRT2 | 104# | 350 | | | | |
| DESTIN | 672# | | | | | |
| DFCTIV | 120# | 226 | | | | |
| DLRSW | 79# | | | | | |
| DOLLAR | 678 | 701# | | | | |
| DONE | 924 | 929 | 931# | | | |
| DPART1 | 112# | 274 | | | | |
| DPART2 | 113# | 347 | | | | |
| DREJCT | 705# | 712 | | | | |
| DSEND | 221 | 227 | 508 | 576 | 753 | 795# |
| DTLOOP | 492# | 515 | | | | |
| ELFCMP | 475 | 479# | | | | |
| EMTSEN | 1011 | 1021# | | | | |
| ERDFLT | 126# | 501 | | | | |
| ERDT | 97# | 579 | | | | |
| ERDTIM | 158# | 333 | 491 | 578 | | |
| EROFF | 115# | 328 | | | | |
| ERTN | 106# | 236 | 331 | 481 | 567 | 582 |
| ERTN1 | 114# | 318 | | | | |
| ESCRET | 122# | 575 | | | | |
| ESCROW | 321 | 572# | | | | |
| EXG2 | 196 | 198 | 200# | | | |
| EXTESC | 573 | 578# | | | | |
| FSAVE1 | 142# | 299 | | | | |
| FSAVE2 | 143# | 210 | 368 | | | |
| FSTRBE | 748 | 757# | | | | |
| FUSE1 | 140# | 254 | | | | |
| FUSE2 | 141# | 308 | | | | |
| GATE1 | 82# | 741 | 751 | 764 | | |
| GATE2 | 84# | 199 | 743 | 751 | | |
| GATEA | 747# | 749 | | | | |
| GATEB | 766# | | | | | |
| GATES | 741# | | | | | |
| HEXASC | 860 | 862 | 874# | | | |
| HF1 | 72# | 192 | 250 | | | |
| HF1X | 254# | | | | | |
| HF1X0 | 259# | | | | | |
| HF1X1 | 261 | 264# | | | | |
| HF1X2 | 269 | 273# | | | | |
| HF1X3 | 266 | 282# | | | | |
| HF1X4 | 285 | 292# | | | | |
| HF1X5 | 279 | 294 | 296# | | | |
| HF1XA | 260 | 262# | | | | |
| HF2 | 74# | 192 | 304 | | | |
| HF2X | 308# | | | | | |
| HF2X0 | 313# | | | | | |
| HF2X1 | 320 | 323# | | | | |
| HF2X3 | 314 | 327# | | | | |
| HF2X3A | 324 | 335 | 338# | | | |
| HF2X4 | 343 | 346# | | | | |
| HF2X5 | 340 | 356# | | | | |
| HF2X6 | 359 | 363# | | | | |
| HF2X7 | 353 | 365# | | | | |
| HILEV | 681# | 696 | | | | |
| HILOSW | 80# | | | | | |
| INHIB | 105# | 236 | 481 | 551 | 581 | |
| INTR | 86# | 804 | 824 | | | |
| INVEN | 688# | 698 | | | | |
| ITIME | 95# | 912 | | | | |
| JAM | 724# | | | | | |
| JMPRS | 568 | 583# | | | | |
| JSCN3 | 389# | | | | | |
| KOIN | 596# | | | | | |
| KOIN0 | 627# | | | | | |
| KOIN1 | 636 | 642# | | | | |
| KOIN2 | 644 | 648# | | | | |
| KOIN3 | 649# | 651 | | | | |
| KOIN4 | 656# | | | | | |
| KOIN5 | 663# | | | | | |
| LF1 | 374# | | | | | |
| LFC1 | 1049# | 1050 | | | | |
| LFC3 | 1055# | 1055 | | | | |
| LFC4 | 1057# | 1058 | | | | |
| LFCMP1 | 432# | | | | | |
| LFCNT | 380 | 417 | 1047# | 1047 | | |
| LFCOMP | 423# | | | | | |
| LFCTST | 376 | 383 | 387# | | | |
| LFLIM | 156# | 432 | 603 | | | |
| LFREF | 76# | 378 | 416 | | | |

ISIS-II ASSEMBLER SYMBOL CR. REFERENCE, V2.1

| | | | | | |
|---|---|---|---|---|---|
| LFVAL | 603# | | | | |
| LFVAL1 | 606# | 623 | | | |
| LFVAL2 | 610 | 618# | | | |
| LOLEV | 697# | | | | |
| NEXTDT | 493 | 496 | 513# | | |
| NOSTRB | 123# | 752 | | | |
| NSTROB | 752# | | | | |
| NXTSEN | 1020 | 1026# | | | |
| OVRTST | 920 | 928# | | | |
| P1SET | 247 | 1029 | 1062# | | |
| PWRUP | 119# | 220 | | | |
| QUARTR | 679 | 694# | | | |
| R7MOVE | 1017 | 1024# | | | |
| RDSENS | 218 | 554 | 594 | 991# | |
| READ | 933 | 1057 | 1060# | | |
| RECAL | 527# | | | | |
| REFLF | 151# | 418 | | | |
| RESTRT | 225 | 235# | 510 | 584 | 785 |
| RSJMP | 727 | 785# | | | |
| RSLOOP | 996# | 1031 | | | |
| RST | 77# | 911 | 1052 | | |
| RTABLE | 604 | 1158# | | | |
| SAVEIT | 426 | 428# | | | |
| SAVNEW | 384# | | | | |
| SCAN | 249# | 543 | 564 | | |
| SCAN1 | 270 | 276 | 297 | 304# | |
| SCAN2 | 336 | 344 | 349 | 366 | 373# |
| SCAN3 | 389 | 490# | | | |
| SCNJMP | 549 | 564# | | | |
| SEND | 85# | | | | |
| SENDO | 775 | 799 | 804# | | |
| SENDIT | 563 | 811 | 828# | | |
| SENDLP | 834# | 843 | | | |
| SENDWT | 807# | 808 | 809 | 822 | |
| SENT1 | 1005# | | | | |
| SENT2 | 1006 | 1013# | | | |
| SENT3 | 1014 | 1019# | | | |
| SLFCNT | 1049 | 1052# | | | |
| SLUG | 121# | 645 | | | |
| SNDO | 884 | 888# | | | |
| SND1 | 887 | 890# | | | |
| SNDONE | 837 | 840# | | | |
| SNDWT1 | 814# | 816 | 817 | | |
| SNDWT2 | 820# | 823 | | | |
| SNDZRO | 832 | 838# | | | |
| STARTO | 184# | | | | |
| STBJAM | 130# | 724 | | | |
| STBTST | 742 | 745# | | | |
| STRBE | 75# | 192 | 1038 | | |
| STROB | 150# | 719 | | | |
| STROBE | 718 | 747 | 1037# | | |
| SUBTR | 259 | 313 | 974# | | |
| TENUS | 395# | 397 | 842 | 892 | |
| TINTR | 192# | | | | |
| TSTOSW | 703 | 710# | | | |
| TSTR2 | 779# | 780 | | | |
| TSTSTB | 691 | 718# | | | |
| TUBES | 152# | 994 | | | |
| TWOMS | 394# | 761 | 1000 | | |
| USCSW | 81# | | | | |
| VAL1 | 1074# | 1090 | | | |
| VAL2 | 1080 | 1086# | | | |
| VALUE | 599 | 601 | 1073# | | |
| XCOIN | 542 | 589# | | | |
| XCOIN1 | 590 | 594# | | | |
| XMITM | 755 | 767 | 775# | | |
| XMTACC | 864 | 869 | 871 | 881# | |
| XMTALF | 886# | 893 | | | |
| XMTDBG | 509 | 777 | 855# | | |
| XMTLOP | 858# | 866 | | | |

CROSS REFERENCE COMPLETE

| | MSB | | | | | | | LSB |
|---|---|---|---|---|---|---|---|---|
| Bit weight | 7 | 6 | 5 | 4 | 3 | 2 | 1 | 0 |
| Coin Acceptance | 0 | COIN VALUE | | EMPTY SENSORS 5c | 10c | 25c | STATUS BITS | |
| Coin accepted to the Cash Box | 0 | 1 (5c) | 1 | 1 = Not Empty | | | 0 | 0 |
| | 0 | 1 (10c) | 0 | | | | | |
| Coin accepted to the Inventory tubes | 0 | 0 (25c) | 1 | 0 = Empty | | | 0 | 1 |
| | 0 | 0 ($1.0) | 0 | | | | | |
| Escro Return | 0 | 1 | 1 | * | 1 | 1 | 1 | 0 |
| Dollar coin default | 0 | 0 | 0 | * | 0 | 0 | 1 | 1 |
| Escro Ret. default | 0 | 0 | 0 | * | 0 | 1 | 1 | 1 |
| Coin drop default | 0 | 0 | 0 | * | 1 | 0 | 1 | 1 |
| | 0 | 0 | 0 | * | 1 | 1 | 1 | 1 |
| Double arrival | 0 | 0 | 1 | * | 0 | 0 | 1 | 1 |
| Jammed Strobe | 0 | 0 | 1 | * | 0 | 1 | 1 | 1 |
| | 0 | 0 | 1 | * | 1 | 0 | 1 | 1 |
| | 0 | 0 | 1 | * | 1 | 1 | 1 | 1 |
| | 0 | 1 | 0 | * | 0 | 0 | 1 | 1 |
| | 0 | 1 | 0 | * | 0 | 1 | 1 | 1 |
| | 0 | 1 | 0 | * | 1 | 0 | 1 | 1 |
| | 0 | 1 | 0 | * | 1 | 1 | 1 | 1 |
| Power Up * | 0 | 1 | 1 | * | 0 | 0 | 1 | 1 |
| Defective sensor * | 0 | 1 | 1 | * | 0 | 1 | 1 | 1 |
| Slug (coin reject) | 0 | 1 | 1 | * | 1 | 0 | 1 | 1 |
| No Strobe | 0 | 1 | 1 | * | 1 | 1 | 1 | 1 |
| Coin Tube Status | 0 | 0 | 1 | MT5c | MT10C | MT25c | 1 | 1 |

* - Bit 4 in the above messages is used to indicate the status of the "high /low" quarter inventory option. A "1" indicates high level and a "0" indicates low.

I claim:

1. A method for examining coins comprising the steps of storing information regarding the relationship between an acceptable phase shift and the frequency of a first signal comprising a low frequency electrical signal, generating the first signal with a first inductor located on one side of a coin passageway, monitoring the frequency of the first signal, receiving a portion of the first signal which is transmitted across the coin passageway, said portion received with a second inductor located on the other side of the coin passageway, and producing a second signal, measuring the phase shift between the first signal and the second signal when a coin is between the first and second inductors, determining an acceptable phase shift for an acceptable coin based upon the monitored frequency of the first signal and the stored information, and comparing the measured phase shift and the acceptable phase shift to determine if the coin is an acceptable coin.

2. The method of claim 1 wherein the frequency of the transmitted low frequency signal is in the range of 1 to 75 kHz.

3. The method of claim 1 wherein the frequency of the transmitted low frequency signal is approximately 5 kHz.

4. A method for examining coins comprising the steps of storing information regarding the relationship between an acceptable phase shift and the frequency of a first signal comprising a low frequency electrical signal, generating the first signal, monitoring the frequency of the first signal, subjecting a coin to an electromagnetic field transmitted by a first inductor driven by the first signal, receiving a portion of the transmitted signal with a second inductor which thereby produces a second low frequency signals as its output, measuring the phase shift between the first signal and the second signal, determining an acceptable phase shift for an acceptable coin based upon the monitored frequency of the first signal and the stored information, and comparing the measured phase shift and the acceptable phase shift to determine if the coin is acceptable.

5. The method of claim 4 wherein the frequency of the first signal is in the range of 1 to 75 kHz.

6. The method of claim 4 wherein the frequency of the first signal is approximately 5 kHz.

7. The method of claim 4 wherein the frequency of the first signal is monitored by squaring the first signal so that a first square wave signal having the same frequency as the first signal is produced, and monitoring the frequency of the first square wave signal.

8. The method of claim 7 wherein the frequency of the first signal is in the range of 1 to 75 kHz.

9. The method of claim 7 wherein the frequency of the first signal is approximately 5 kHz.

10. The method claim 7 wherein the phase shift between the first signal and the second signal is measured by inverting and squaring the second signal so that a second square wave signal 180° out of phase and having the same frequency as the second signal is produced, generating a rapid clock signal, and logically gating the first square wave signal, the second square wave signal and the rapid clock signal so that a plurality of output pulses are produced at the output of a logic gate means whenever the first square wave signal, the second square wave signal and the rapid clock signal are all coincidentally high.

11. The method of claim 10 wherein the frequency of the first signal is in the range of 1 to 75 kHz.

12. The method of claim 10 wherein the frequency of the first signal is approximately 5 kHz.

13. The method of claim 10 further comprising counting the output pulses at the output of the logic gate means and generating a first phase shift count indicative of the measured phase shift between the first signal and the second signal.

14. The method of claim 13 wherein the acceptable phase shift is determined by using the frequency of the first square wave signal to calculate an acceptable phase shift count.

15. The method of claim 14 further comprising the step of storing an equation relating the acceptable phase shift count to the frequency of the first signal and wherein the acceptable phase shift count is calculated by solving the stored equation using the monitored frequency of the first square wave signal.

16. The method of claim 1 wherein the step of determining an acceptable phase shift comprises generating a range of acceptable phase shift counts suitable for acceptable coins of a particular denomination coin which is to be accepted.

17. The method of claim 16 further comprising the steps of producing a measured phase shift count based upon the measured phase shift between the first and second signals and producing a signal indicative of an acceptable coin when the measured phase shift count falls within the range of acceptable phase shift counts.

18. Apparatus for examining coins comprising means defining a coin passageway, means for producing a first low frequency electrical signal, means for storing information regarding the relationship between an accepted phase shift and the frequency of the first signal, means to monitor the frequency of the first signal, a first inductor connected to the output of the first signal producing means, the first inductor being located on one side of the coin passageway and arranged to produce an electromagnetic field in the coin passageway, a second inductor located on the other side of the coin passageway from the first inductor so that coins to be examined will pass between the first and second inductors, the second inductor being arranged to receive a portion of the field and to produce a second low frequency signal as its output, means to measure the phase shift between the first signal and the second signal, means to determine the acceptable phase shift for an acceptable coin based upon the monitored frequency of the first signal and said information, and means to compare the measured phase shift and the acceptable phase shift.

19. The apparatus of claim 18 wherein the frequency of the first signal is in the range of 1 to 75 kHz.

20. The apparatus of claim 18 wherein the frequency of the first signal is approximately 5 kHz.

21. The apparatus of claim 18 wherein the means for producing the first signal comprises an oscillator having its output connected to the first inductor.

22. The apparatus of claim 18 wherein the means to monitor the frequency of the first signal comprises a first squaring circuit, the first squaring circuit producing a first square wave at its output and having an input connected to the output of the means for producing the first signal.

23. The apparatus of claim 22 wherein the first squaring circuit further comprises a second input connected to a biasing circuit and wherein its output is connected to a first input of a logic means.

24. The apparatus of claim 23 wherein the logic means comprises a microprocessor having a plurality of inputs, the microprocessor being programmed to determine the frequency of the signal applied to its first input.

25. The apparatus of claim 24 wherein the microprocessor is programmed to calculate the acceptable phase shift based upon the frequency of signal applied to its first input.

* * * * *

UNITED STATES PATENT AND TRADEMARK OFFICE

CERTIFICATE OF CORRECTION

PATENT NO. : 4,493,411

DATED : January 15, 1985

INVENTOR(S) : Frederic P. Heiman

It is certified that error appears in the above—identified patent and that said Letters Patent is hereby corrected as shown below:

Col. 5, line 34 "returning" should be --retuning--.

Signed and Sealed this

*Seventeenth* Day of *September 1985*

[SEAL]

*Attest:*

*Attesting Officer*

DONALD J. QUIGG

*Commissioner of Patents and Trademarks—Designate*

UNITED STATES PATENT AND TRADEMARK OFFICE

CERTIFICATE OF CORRECTION

PATENT NO. : 4,493,411

DATED : January 15, 1985

INVENTOR(S) : Frederic P. Heiman

It is certified that error appears in the above—identified patent and that said Letters Patent is hereby corrected as shown below:

Col. 6, line 7 "3,970,086" should be --3,907,086--.

Signed and Sealed this

Seventh Day of January 1986

[SEAL]

*Attest:*

DONALD J. QUIGG

*Attesting Officer*

*Commissioner of Patents and Trademarks*